US009215764B1

(12) United States Patent
Zhou et al.

(10) Patent No.: US 9,215,764 B1
(45) Date of Patent: Dec. 15, 2015

(54) HIGH-TEMPERATURE ULTRA-LOW RIPPLE MULTI-STAGE LED DRIVER AND LED CONTROL CIRCUITS

(71) Applicant: SORAA, INC., Fremont, CA (US)

(72) Inventors: Dong Zhou, Cupertino, CA (US); Frank Shum, Sunnyvale, CA (US); Michael Tran, Fremont, CA (US); John Carpenter, Fremont, CA (US); Richard Carnes, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 0 days.

(21) Appl. No.: 14/075,936

(22) Filed: Nov. 8, 2013

Related U.S. Application Data

(60) Provisional application No. 61/844,200, filed on Jul. 9, 2013, provisional application No. 61/836,442, filed on Jun. 18, 2013, provisional application No. 61/724,639, filed on Nov. 9, 2012.

(51) Int. Cl.
*H05B 37/02* (2006.01)
*H05B 33/08* (2006.01)
*H05B 33/10* (2006.01)

(52) U.S. Cl.
CPC ..... *H05B 33/0809* (2013.01); *H05B 33/10* (2013.01)

(58) Field of Classification Search
CPC .... H05B 33/0815; H05B 37/02; H05B 39/06; H05B 41/36
USPC ..... 315/224, 247, 294, 297, 307, 309
See application file for complete search history.

(56) References Cited

U.S. PATENT DOCUMENTS

| | | | |
|---|---|---|---|
| 2,953,970 | A | 9/1960 | Maynard |
| 3,283,143 | A | 11/1966 | Gosnell |
| 3,593,021 | A | 7/1971 | Auerbach |
| 3,621,233 | A | 11/1971 | Ferdinand et al. |
| 3,874,443 | A | 4/1975 | Bayer, Jr. |
| 4,165,919 | A | 8/1979 | Little |
| 4,225,904 | A | 9/1980 | Linder |
| 4,279,463 | A | 7/1981 | Little |
| 4,293,892 | A | 10/1981 | Plummer |
| 5,005,109 | A | 4/1991 | Carleton |
| 6,116,758 | A | 9/2000 | Lin |
| 6,204,602 | B1 | 3/2001 | Yang et al. |
| D471,881 | S | 3/2003 | Hegde |
| 6,787,999 | B2 | 9/2004 | Stimac et al. |
| 6,864,572 | B2 | 3/2005 | Lee et al. |
| 6,889,006 | B2 | 5/2005 | Kobayashi |

(Continued)

FOREIGN PATENT DOCUMENTS

| | | |
|---|---|---|
| CN | 1849707 | 10/2006 |
| CN | 2826150 Y | 10/2006 |

(Continued)

OTHER PUBLICATIONS

Nakamura, 'Candela-Class High-Brightness InGaN/AlGaN Double-Heterostructure Blue-Light-Emitting Diodes', Applied Physics Letters, vol. 64, No. 13, Mar. 1994, pp. 1687-1689.

(Continued)

*Primary Examiner* — Tung X Le
(74) *Attorney, Agent, or Firm* — Saul Ewing LLP

(57) ABSTRACT

Techniques for high temperature ultra-low ripple multi-stage LED driver circuit together with LED control circuits are disclosed.

14 Claims, 25 Drawing Sheets

(56) References Cited

U.S. PATENT DOCUMENTS 6,942,368 B1 9/2005 Kane et al.
6,964,877 B2 11/2005 Chen et al.
7,207,694 B1 4/2007 Petrick
D545,457 S 6/2007 Chen
7,311,417 B1 12/2007 Lemke
7,344,279 B2 3/2008 Mueller et al.
7,388,751 B2 6/2008 Hood et al.
7,431,071 B2 10/2008 Wenger
D581,583 S 11/2008 Peng
7,458,706 B1 12/2008 Liu et al.
7,488,097 B2 2/2009 Reisenauer et al.
7,506,998 B2 3/2009 Ansems et al.
D592,613 S 5/2009 Plonski et al.
7,631,987 B2 12/2009 Wei
7,637,635 B2 12/2009 Xiao et al.
7,658,528 B2 2/2010 Hoelen et al.
7,663,229 B2 2/2010 Lu et al.
7,674,015 B2 3/2010 Chien
7,712,922 B2 5/2010 Hacker et al.
D618,634 S 6/2010 Lin et al.
7,744,259 B2 6/2010 Walczak et al.
D619,551 S 7/2010 Lin et al.
7,748,870 B2 7/2010 Chang et al.
7,753,107 B2 7/2010 Zhou et al.
7,800,119 B2 9/2010 He et al.
7,824,075 B2 11/2010 Maxik
7,824,077 B2 11/2010 Chen et al.
7,889,421 B2 2/2011 Narendran et al.
7,972,040 B2 7/2011 Li et al.
7,993,025 B2 8/2011 Chiu
7,993,031 B2 8/2011 Grajcar
7,997,774 B2 8/2011 Liddle
8,042,969 B2 10/2011 Paik et al.
8,049,122 B2 11/2011 Watford
D652,564 S 1/2012 Maxik
8,153,475 B1 4/2012 Shum et al.
8,157,422 B2 4/2012 Paik et al.
8,164,237 B2 4/2012 Wen
8,206,015 B2 6/2012 Cho et al.
D662,899 S 7/2012 Shum et al.
D662,900 S 7/2012 Shum et al.
8,215,800 B2 7/2012 Plank
8,220,970 B1 7/2012 Khazi et al.
8,227,962 B1 7/2012 Su
8,242,669 B2 8/2012 Qiu
8,258,706 B2 * 9/2012 Maruyama et al. ..... 315/119
8,272,762 B2 9/2012 Maxik et al.
8,324,835 B2 12/2012 Shum et al.
D674,960 S 1/2013 Chen et al.
8,390,207 B2 3/2013 Dowling et al.
8,405,947 B1 3/2013 Green et al.
8,414,151 B2 4/2013 Allen et al.
8,525,396 B2 9/2013 Shum et al.
8,567,999 B2 10/2013 Paik et al.
8,579,470 B1 11/2013 Leahy et al.
D694,722 S 12/2013 Shum et al.
8,618,742 B2 12/2013 Shum et al.
8,643,257 B2 2/2014 Shum et al.
8,651,711 B2 2/2014 Rudisill et al.
8,680,787 B2 * 3/2014 Veskovic ..... 315/307
8,746,918 B1 6/2014 Rubino
8,752,975 B2 6/2014 Rubino
8,803,452 B2 8/2014 Shum et al.
8,829,774 B1 9/2014 Shum et al.
8,884,501 B2 11/2014 Cho et al.
8,884,517 B1 11/2014 Shum et al.
8,888,332 B2 11/2014 Martis et al.
2001/0021073 A1 9/2001 Leggo et al.
2003/0039122 A1 2/2003 Cao
2003/0058650 A1 3/2003 Shih
2003/0107885 A1 6/2003 Galli
2003/0183835 A1 10/2003 Moku et al.
2004/0222427 A1 11/2004 Hsiung
2004/0264195 A1 12/2004 Chang et al.
2005/0122690 A1 6/2005 Hood et al.
2005/0174780 A1 8/2005 Park
2006/0028310 A1 2/2006 Asano et al.
2006/0175045 A1 8/2006 Chen
2006/0262545 A1 11/2006 Piepgras et al.
2006/0274529 A1 12/2006 Cao
2007/0007898 A1 1/2007 Bruning
2007/0158797 A1 7/2007 Lee
2007/0228999 A1 10/2007 Kit
2007/0284564 A1 12/2007 Biwa et al.
2008/0002444 A1 1/2008 Shekhawat et al.
2008/0049399 A1 2/2008 Lu et al.
2008/0080137 A1 4/2008 Otsuki et al.
2008/0123341 A1 5/2008 Chiu
2008/0158887 A1 7/2008 Zhu et al.
2008/0266866 A1 10/2008 Tsai
2008/0315228 A1 12/2008 Krames et al.
2009/0027878 A1 1/2009 Metz et al.
2009/0134421 A1 5/2009 Negley
2009/0154166 A1 6/2009 Zhang et al.
2009/0161356 A1 6/2009 Negley et al.
2009/0175043 A1 7/2009 Frick
2009/0194252 A1 8/2009 Lee et al.
2009/0195186 A1 8/2009 Guest et al.
2009/0231895 A1 9/2009 Hu
2009/0237940 A1 9/2009 Wu et al.
2009/0244899 A1 10/2009 Chyn
2009/0303738 A1 12/2009 Suss et al.
2009/0303762 A1 12/2009 Jang et al.
2010/0060130 A1 3/2010 Li
2010/0061076 A1 3/2010 Mandy et al.
2010/0066266 A1 3/2010 Huang et al.
2010/0091487 A1 4/2010 Shin
2010/0207502 A1 8/2010 Cao et al.
2010/0207534 A1 8/2010 Dowling et al.
2010/0244648 A1 9/2010 Yoo
2010/0264799 A1 10/2010 Liu et al.
2010/0277068 A1 11/2010 Broitzman
2010/0290229 A1 11/2010 Meyer, Sr. et al.
2010/0320499 A1 12/2010 Catalano et al.
2011/0018418 A1 1/2011 Yoo
2011/0032708 A1 2/2011 Johnston et al.
2011/0074270 A1 3/2011 Van De Ven et al.
2011/0095686 A1 4/2011 Falicoff et al.
2011/0140586 A1 6/2011 Wang
2011/0169406 A1 7/2011 Weekamp et al.
2011/0175510 A1 7/2011 Rains, Jr. et al.
2011/0175528 A1 7/2011 Rains, Jr. et al.
2011/0182065 A1 7/2011 Negley et al.
2011/0198979 A1 8/2011 Shum et al.
2011/0204763 A1 8/2011 Shum et al.
2011/0204779 A1 8/2011 Shum et al.
2011/0204780 A1 8/2011 Shum et al.
2011/0215699 A1 9/2011 Le et al.
2011/0242823 A1 10/2011 Tracy et al.
2011/0260945 A1 10/2011 Karasawa
2011/0298371 A1 12/2011 Brandes et al.
2011/0309734 A1 12/2011 Lin et al.
2012/0018754 A1 1/2012 Lowes
2012/0043552 A1 2/2012 David et al.
2012/0043913 A1 * 2/2012 Melanson ..... 315/307
2012/0161626 A1 6/2012 van de Ven et al.
2012/0187830 A1 7/2012 Shum et al.
2012/0212960 A1 * 8/2012 Rodriguez ..... 362/249.02
2012/0293062 A1 11/2012 Pickard
2012/0314403 A1 12/2012 Kennedy et al.
2012/0319148 A1 12/2012 Donofrio et al.
2012/0320579 A1 12/2012 Ferguson et al.
2013/0058099 A1 3/2013 Shum et al.
2013/0322089 A1 12/2013 Martis et al.
2013/0343062 A1 12/2013 Shum et al.
2014/0028214 A1 * 1/2014 Mazumdar et al. ..... 315/279
2014/0091697 A1 4/2014 Shum

(56) References Cited

U.S. PATENT DOCUMENTS

| | | | |
|---|---|---|---|
| 2014/0146545 | A1 | 5/2014 | Shum et al. |
| 2014/0175966 | A1 | 6/2014 | Tan |
| 2014/0313749 | A1 | 10/2014 | Shum et al. |

FOREIGN PATENT DOCUMENTS

| | | |
|---|---|---|
| CN | 2009-75612 | 11/2007 |
| CN | 101608746 | 8/2011 |
| CN | 102149960 | 8/2011 |
| CN | 203099372 U | 7/2013 |
| JP | 02-028541 | 1/1990 |
| JP | 2000-517465 | 12/2000 |
| JP | 2005-302483 | 10/2009 |
| JP | 2011-501351 | 1/2011 |
| WO | WO 2009/048956 | 4/2009 |
| WO | WO 2009/149263 | 12/2009 |
| WO | WO 2009/156969 | 12/2009 |
| WO | WO 2011/054716 | 5/2011 |

OTHER PUBLICATIONS

International Preliminary Report & Written Opinion of PCT Application No. PCT/US2011/060030 dated Mar. 21, 2012, 11 pgs. total.
CFL Ballast IC Drive LED, www.placardshop.com, Blog, May 22, 2012, 3 pages.
Rausch, 'Use a CFL ballast to drive LEDs', EDN Network, 2007, pp. 1-2.
Communication from the Japanese Patent Office re 2012191931, dated Oct. 11, 2013, 11 pages.
USPTO Office Action for U.S. Appl. No. 13/025,791 dated Nov. 25, 2011 (11 pages).
USPTO Office Action for U.S. Appl. No. 13/025,791 dated Feb. 20, 2013 (13 pages).
USPTO Notice of Allowance for U.S. Appl. No. 13/025,791 dated Jun. 17, 2013 (8 pages).
USPTO Office Action for U.S. Appl. No. 13/025,833 dated Dec. 14, 2011 (10 pages).
USPTO Office Action for U.S. Appl. No. 13/025,833 dated Jul. 12, 2012 (15 pages).
USPTO Office Action for U.S. Appl. No. 13/025,833 dated Apr. 26, 2013 (22 pages).
USPTO Notice of Allowance for U.S. Appl. No. 13/025,833 dated Oct. 11, 2013 (11 pages).
USPTO Office Action for U.S. Appl. No. 13/025,849 dated Mar. 15, 2013 (17 pages).
USPTO Notice of Allowance for U.S. Appl. No. 13/025,849 dated Sep. 16, 2013 (10 pages).
USPTO Office Action for U.S. Appl. No. 13/025,860 dated Dec. 30, 2011 (14 pages).
USPTO Notice of Allowance for U.S. Appl. No. 13/025,860 dated Jun. 8, 2012 (9 pages).
USPTO Office Action for U.S. Appl. No. 13/274,489 dated Sep. 6, 2013 (12 pages).
USPTO Office Action for U.S. Appl. No. 13/480,767 dated Oct. 25, 2013 (28 pages).
USPTO Office Action for U.S. Appl. No. 13/535,142 dated Aug. 1, 2013 (13 pages).
USPTO Office Action for U.S. Appl. No. 13/535,142 dated Nov. 14, 2013 (23 pages).
USPTO Office Action for U.S. Appl. No. 13/959,422 dated Oct. 8, 2013 (10 pages).
USPTO Notice of Allowance for U.S. Appl. No. 29/399,523 dated Mar. 5, 2012 (7 pages).
USPTO Notice of Allowance for U.S. Appl. No. 29/399,524 dated Mar. 2, 2012 (8 pages).
USPTO Notice of Allowance for U.S. Appl. No. 29/423,725 dated Jul. 19, 2013 (9 pages).
'Thermal Properties of Plastic Materials', Professional Plastics, Aug. 21, 2010, pp. 1-4.
Communication from the Chinese Patent Office re 201210322687.1 dated Mar. 3, 2014, (13 pages).
USPTO Office Action for U.S. Appl. No. 13/535,142 dated Feb. 25, 2014 (23 pages).
USPTO Notice of Allowance for U.S. Appl. No. 13/274,489 dated Sep. 30, 2014 (7 pages).
USPTO Office Action for U.S. Appl. No. 13/535,142 dated Sep. 22, 2014 (25 pages).
USPTO Notice of Allowance for U.S. Appl. No. 13/856,613 dated Nov. 21, 2014 (8 pages).
USPTO Notice of Allowance for U.S. Appl. No. 13/909,752 dated Sep. 30, 2014 (9 pages).
USPTO Office Action for U.S. Appl. No. 14/014,112 dated Nov. 19, 2014 (24 pages).
USPTO Office Action for U.S. Appl. No. 14/054,597 dated Dec. 5, 2014 (9 pages).
USPTO Office Action for U.S. Appl. No. 14/097,043 dated Oct. 15, 2014 (11 pages).
USPTO Office Action for U.S. Appl. No. 14/211,606 dated Nov. 28, 2014 (18 pages).
Communication from the Chinese Patent Office re 2011800543977 dated Jan. 7, 2015 (13 pages).
USPTO Office Action for U.S. Appl. No. 13/480,767 dated Dec. 18, 2014 (17 pages).
USPTO Office Action for U.S. Appl. No. 13/855,423 dated Mar. 17, 2015 (22 pages).
USPTO Notice of Allowance for U.S. Appl. No. 29/441,108 dated Mar. 13, 2015 (7 pages).
USPTO Notice of Allowance for U.S. Appl. No. 29/469,709 dated Feb. 6, 2015 (5 pages).
Thermal Properties of Plastic Materials, Professional Plastics, Aug. 21, 2010, pp. 1-4.
Communication from the Japanese Patent Office re 2013532993 dated Jul. 9, 2014 (5 pages).
USPTO Notice of Allowance for U.S. Appl. No. 13/269,193 dated Mar. 31, 2014 (8 pages).
USPTO Office Action for U.S. Appl. No. 13/274,489 dated Mar. 27, 2014 (14 pages).
USPTO Office Action for U.S. Appl. No. 13/480,767 dated Apr. 29, 2014 (21 pages).
USPTO Notice of Allowance for U.S. Appl. No. 13/959,422 dated Jul. 9, 2014 (7 pages).

* cited by examiner

HIGH-TEMPERATURE ULTRA-LOW RIPPLE MULTI-STAGE LED DRIVER AND LED CONTROL CIRCUITS

RELATED APPLICATIONS

This application claims benefit under 35 U.S.C. §119(e) to U.S. Provisional Application No. 61/724,639 filed on Nov. 9, 2012, and to U.S. Provisional Application No. 61/844,200 filed on Jul. 9, 2013; each of which is incorporated by reference in its entirety.

FIELD

The disclosure relates to the field of LED illumination systems and more particularly to techniques for making and using a high-temperature ultra-low ripple multi-stage LED driver circuit and techniques for implementing LED control circuits.

BACKGROUND

Legacy LED driver solutions that achieve a suitably high power factor often include single-stage flyback and buck converters using electrolytic capacitors. However, as modern LED illumination systems are configured to produce more and more light output (e.g., lumens), the operating temperature in the illumination system (e.g., lamp) increases, and the increased temperature of operation begins to play a factor in reliability of the aforementioned electrolytic capacitors. Additionally, the aforementioned electrolytic capacitors in combination with the aforementioned legacy single-stage converters suffer high LED ripple current.

Even in cases where legacy LED illumination drivers employ two stages, such legacy two-stage converters have included an electrolytic capacitor to decouple the first and second stages. Although the second stage can be configured to regulate the current to achieve low ripple (e.g., due to the presence of the electrolytic capacitor in these legacy implementations), the combination is not suitable for the needed combination of high temperature operation and long life.

Moreover, trends in LED illumination demand ever more control of light output under various conditions such as when connected to an electronic transformer, and/or for dimming, and/or for operation in environments exhibiting extremely high temperatures and/or extreme temperature changes.

Therefore, there is a need for improved approaches.

SUMMARY

LED illumination systems often comprise a lens, a heat sink, and a base assembly. In exemplary embodiments, the base assembly houses an LED illumination driver as well as pins and conductors for carrying current from a line voltage source (e.g., from a wall socket) to internal electrical components. The LED illumination driver housed in the base assembly provides conditioned current to one or more LED devices, which LED devices in turn convert a voltage to light using a luminescent process in the active region of the LED devices. In one of the exemplary embodiments, a preloading circuit to support startup is located in the lamp driver right after the bridge rectifier. The preloading circuit serves to load the transformer output that powers the lamp for about three half cycles. The preloading circuit will then remove the load, and will not prepare to load again as long as the LED lamp output voltage stays above a particular threshold.

In some lighting situations, an electronic transformer is provided to step-down a high voltage to a lower voltage. During the first few cycles the electronic transformer delivers inrush current, and the voltage step-down may be quite different compared with steady-state step-down. At the same time, LEDs do not turn on right away in order to begin converting electrical energy to light energy. The energy fluctuations of these two systems—the electronic transformer and the LED lamp—need to be managed in order to reduce or eliminate transients during the first few cycles of operation, and also when voltage fluctuations occur for any reason during steady state operation.

Especially in retrofit situations, the aforementioned electronic transformer has been designed to deliver lower voltage power to resistive loads that continuously load more than the minimum needed to operate the electronic transformer. LED lamps present a changing load during operation which may be too small for the transformer in the retrofit situation. Unfortunately, the aforementioned electronic transformer will stop itself when there is momentarily too small a current draw from the LED lamp. However, many electronic transformers can continue to provide power to the LED driver if they can get past the stage of pumping up the output voltage at start-up.

In other situations, dimming and temperature control is needed.

BRIEF DESCRIPTION OF THE DRAWINGS

Those skilled in the art will understand that the drawings, described herein, are for illustration purposes only. The drawings are not intended to limit the scope of the present disclosure.

DETAILED DESCRIPTION

An "LED" refers to a light-emitting diode.

Reference is now made in detail to certain embodiments. The disclosed embodiments are not intended to be limiting of the claims.

Figure 1:
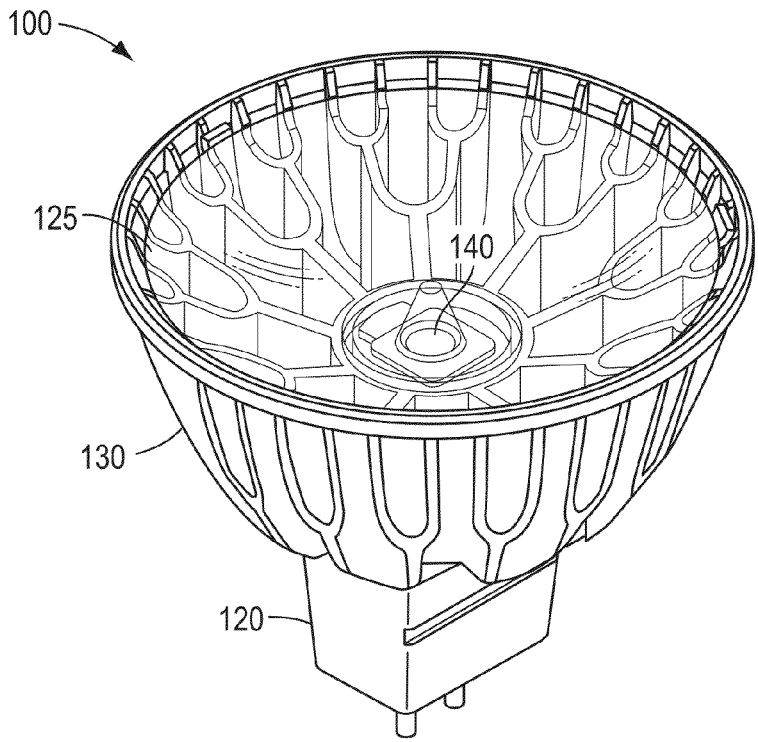
FIG. 1 depicts an LED illumination apparatus in the form of a lamp comprising a lamp base for housing a high-temperature ultra-low ripple multi-stage LED driver circuit, according to some embodiments.

FIG. 1 depicts an LED illumination apparatus in the form of a lamp 100 comprising a lamp base for housing a high-temperature ultra-low ripple multi-stage LED driver circuit.

As shown, the lamp 100 comprises a lamp base 120 that is mechanically affixed to a heat sink 130, which heat sink serves as a holder for a lens 125. An LED 140 is disposed (as shown) between the lamp base 120 and the lens. The lamp base has an inner volume which serves to house electrical components including a high-temperature ultra-low ripple multi-stage LED driver circuit, which embodiments are described herein.

Figure 2A:
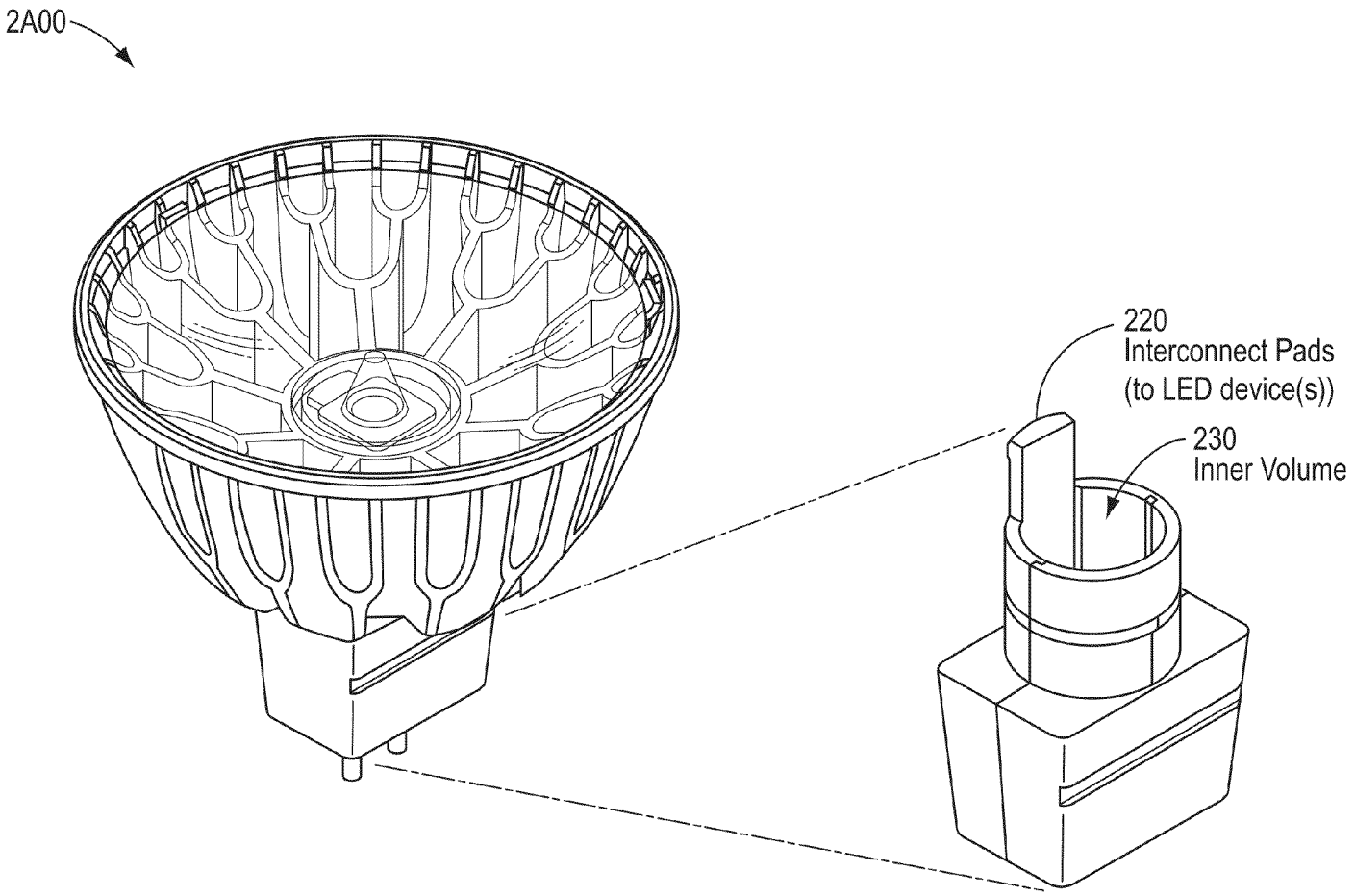
FIG. 2A is a first exploded view showing an LED illumination apparatus having a lamp base for housing a high-temperature ultra-low ripple multi-stage LED driver circuit, according to some embodiments.

FIG. 2A is a first exploded view 2A00 showing an LED illumination apparatus having a lamp base for housing a high-temperature ultra-low ripple multi-stage LED driver circuit.

As shown, the lamp base comprises an inner volume 230. Within this inner volume is disposed one or more electrical components including a high-temperature ultra-low ripple multi-stage LED driver circuit, which in turn serves to drive one or more LEDs. The aforementioned electrical components may be disposed on a printed circuit board (see FIG. 3), and such a printed circuit board may comprise interconnect pads 220 that carry current to LED devices 140.

As can be seen, the lamp base is in proximity to the LED devices, and during lamp operation the heat dissipation within the inner volume (e.g., from the enclosed electrical components) can cause the temperature within the inner volume of the lamp to persist in a range of about 105° C. to about 175° C.

Figure 2B:
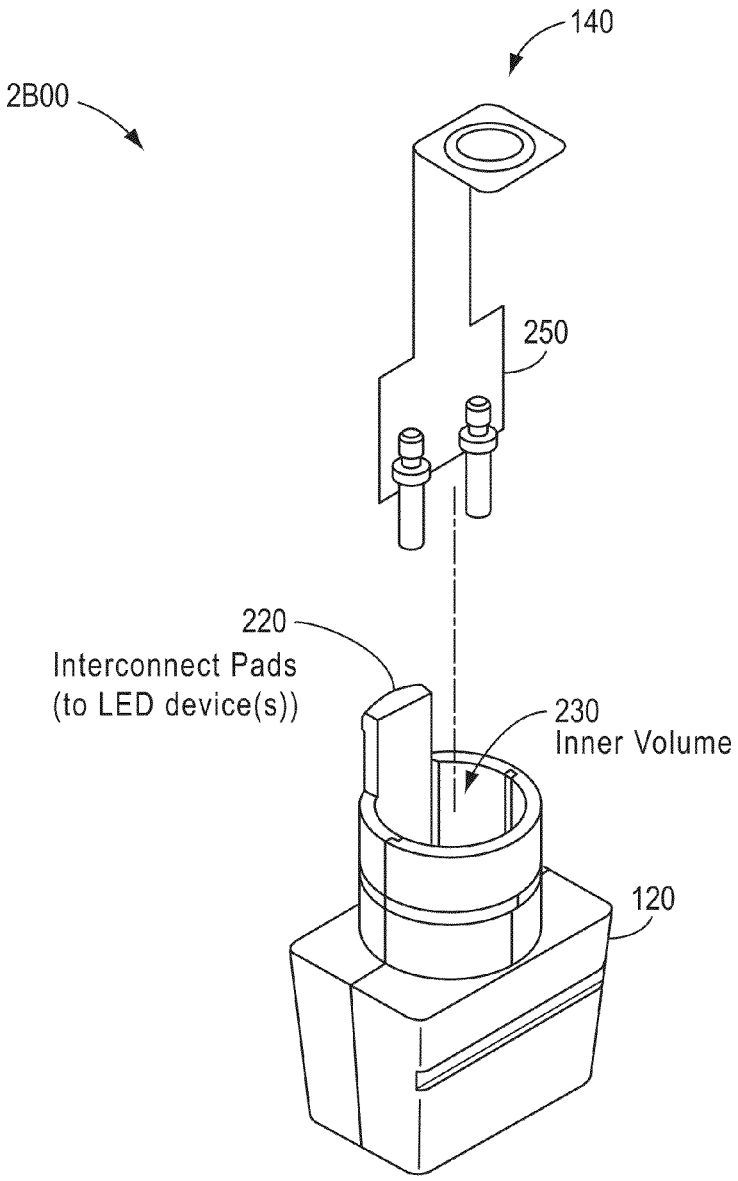
FIG. 2B is a second exploded view showing a lamp base for housing a high-temperature ultra-low ripple multi-stage LED driver circuit, according to some embodiments.

FIG. 2B is a second exploded view 2B00 showing a lamp base for housing a high-temperature ultra-low ripple multi-stage LED driver circuit.

As shown, the lamp base 120 is pre-configured to house an interposer 250, which interposer serves to connect to a current source (e.g., an alternating current source) to a high-temperature ultra-low ripple multi-stage LED driver circuit (see FIG. 3), which in turn serves to drive one or more LEDs 140. The interposer can be rigid or semi-rigid and shaped as shown, or can be flexible and shaped into a foldable flexible printed circuit board.

Figure 3:
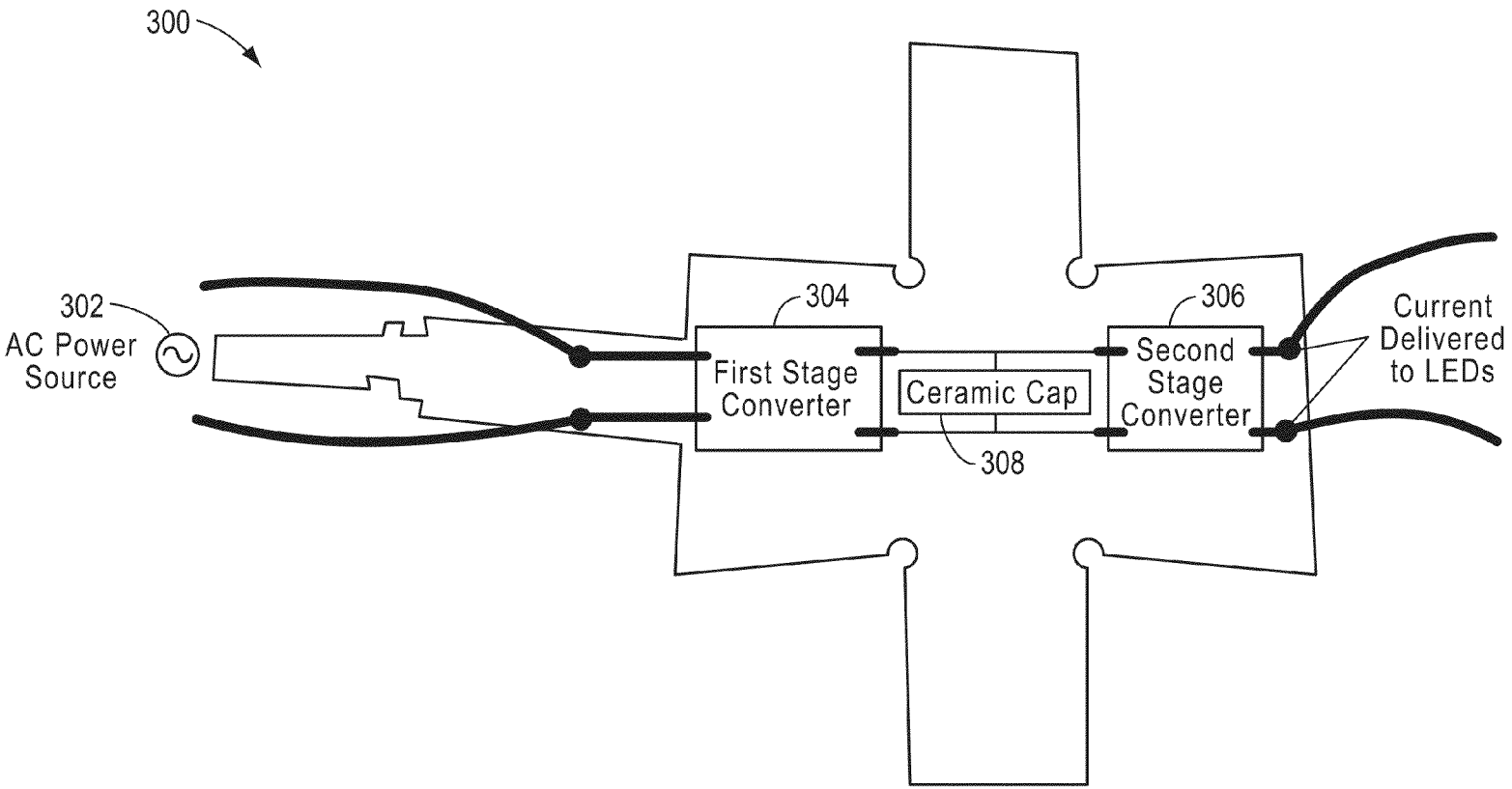
FIG. 3 depicts a flexible printed circuit board upon which is mounted a capacitor used in high-temperature ultra-low ripple multi-stage LED driver circuit, according to some embodiments.

FIG. 3 depicts a flexible printed circuit board 300 upon which is mounted a capacitor used in high-temperature ultra-low ripple multi-stage LED driver circuit.

As shown, the flexible printed circuit board 300 serves as a mount for a first stage converter 304, a second stage converter 306, and a capacitor 308 electrically disposed across the shown terminals between the first stage and the second stage.

In the embodiment shown, the first stage electrically interfaces to an AC current source (e.g., an alternating current power source 302), and the constituent circuits of the first stage converter serve to fulfill input power requirements such as high power factor, as well as to fulfill the electrical requirements for dimmer capabilities, and for achieving transformer compatibility. Between the first stage converter 304 and the second stage converter 306 is a ceramic capacitor 308. This ceramic capacitor is distinguished from electrolytic capacitors. The first stage converter is designed to regulate the average voltage across the ceramic capacitor while limiting the ripple to a specified maximum ripple voltage (see Table 1). Depending on the characteristics of the ripple voltage variance, the capacitor can be a tantalum capacitor, or can be a film-type capacitor, or can be embodied as a single discrete capacitor or as multiple discrete capacitors.

The second stage converter regulates the LED current to DC. Since the first stage converter serves to maintain a high power factor in phase with the AC line, there exist zero crossing events when there is no charge flowing into the capacitor. Accordingly, the voltage across the capacitor exhibits an AC ripple at twice the line frequency of the AC input (e.g., 100 Hz for 50 Hz AC input line, or 120 Hz for 60 Hz AC input line).

The energy E delivered to the second stage from the capacitor is given by:

$$E = CV\Delta V \quad \text{(EQ. 1)}$$

where C represents the capacitance, ΔV is the ripple voltage across the capacitor and V is the average voltage. The following table shows capacitance values in accordance with varying voltage ripple.

TABLE 1

Effect of allowed ripple voltage (volts) on capacitor selection.

| Allowed Ripple Voltage (volts) | Capacitance needed (μF) | Possible Effects on Capacitor Selection |
|---|---|---|
| 5 | 300 | Needs an electrolytic capacitor |
| 15 | 50 | Can be 5 10 μF ceramic capacitor in parallel |
| 40 | 7 | Can be one ceramic capacitor |

Figure 4:
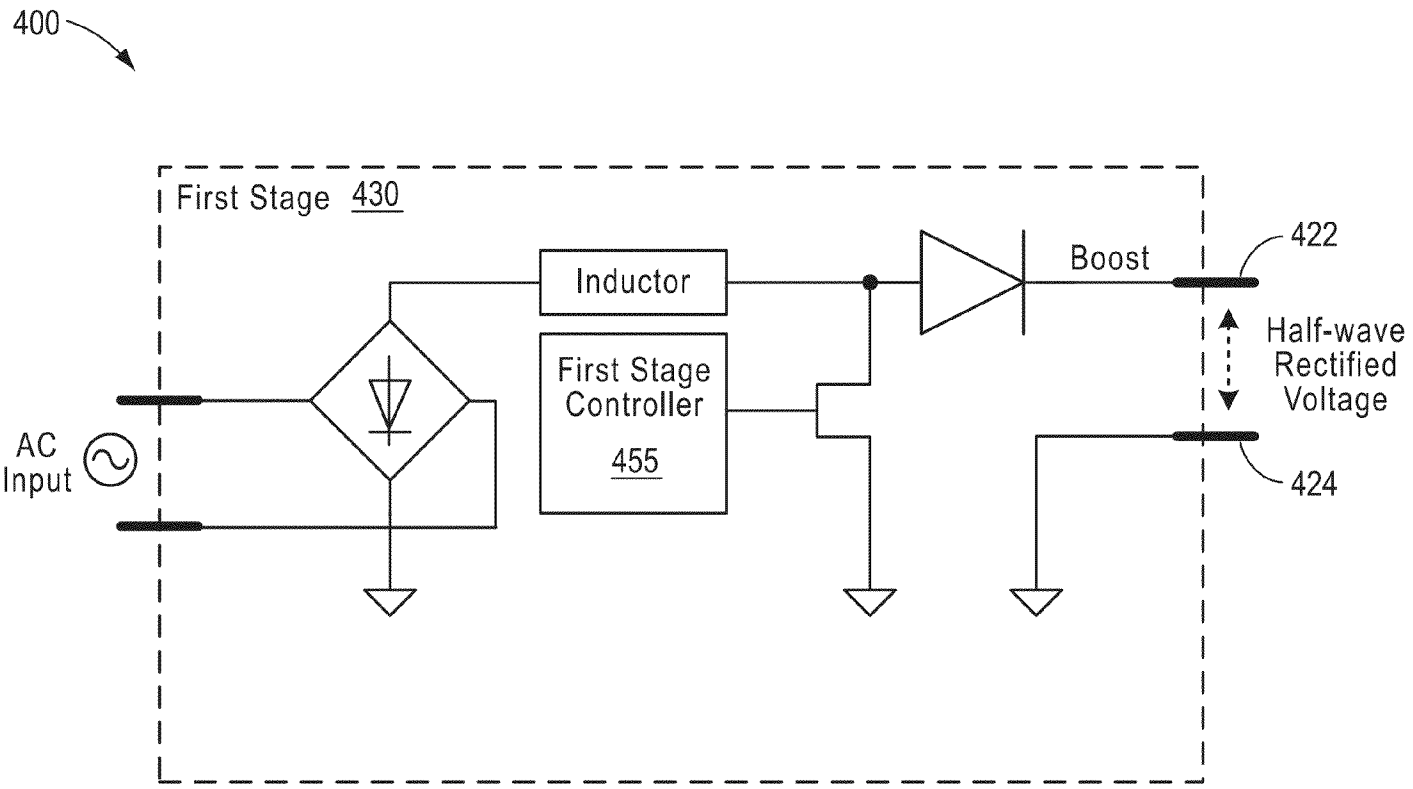
FIG. 4 depicts a schematic of the first stage converter of a high-temperature ultra-low ripple multi-stage LED driver circuit, according to some embodiments.

FIG. 4 depicts a schematic 400 of the first stage converter of a high-temperature ultra-low ripple multi-stage LED driver circuit.

As shown, the first stage 430 has AC in inputs and produces a half-wave rectified voltage across a first terminal 422 and a second terminal 424. Also shown is a rectifier bridge, an inductor, and a first stage controller 455. The controller 455 switches the FET such that the input current is in phase with the input voltage, and the output voltage between terminals 422 and 424 is regulated to a preset level. Although a boost circuit is shown here as an example, other input-friendly circuits such as flyback and certain single-ended primary-inductor converters (SEPIC convertors) can easily apply here as the first stage converter.

Figure 5:
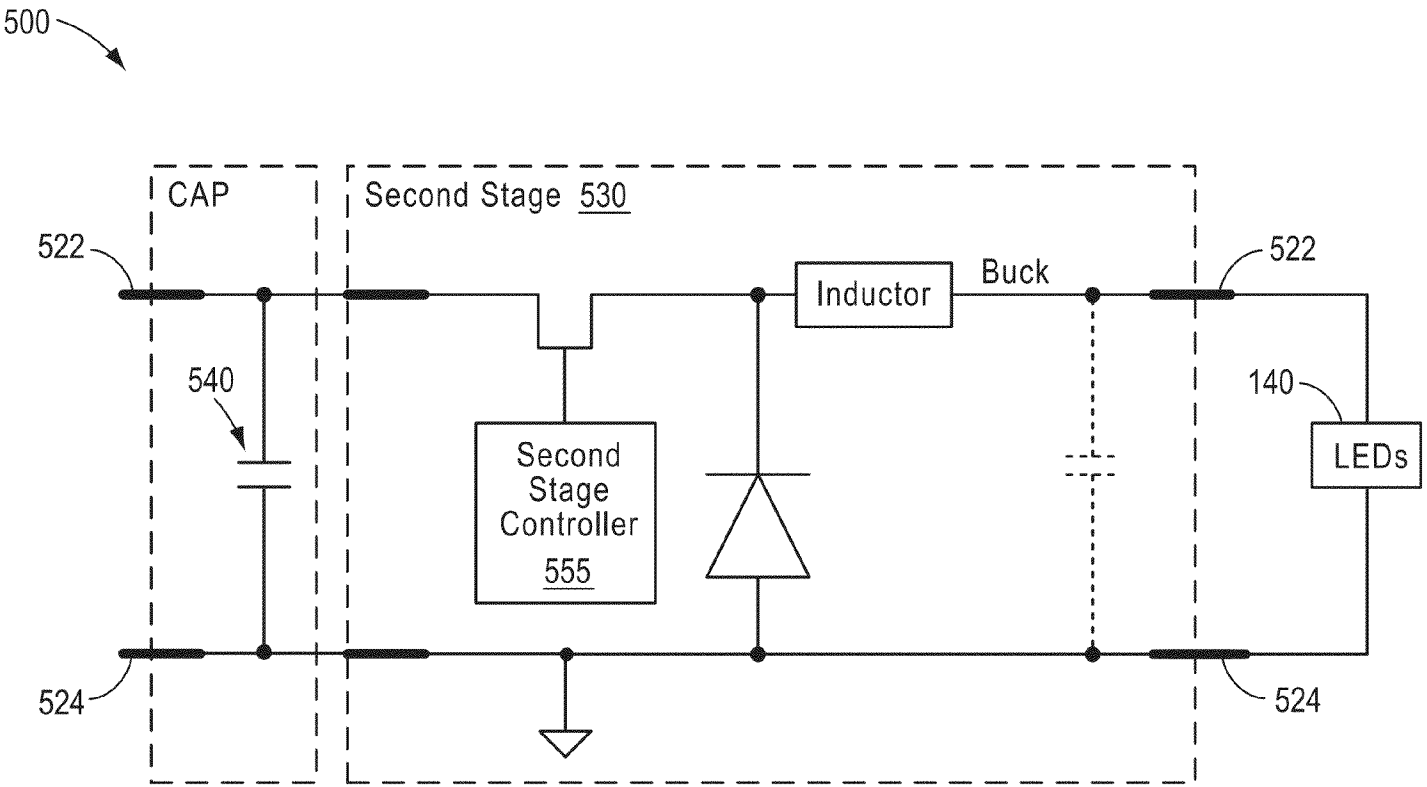
FIG. 5 depicts a schematic of a second stage converter of a high-temperature ultra-low ripple multi-stage LED driver circuit, according to some embodiments.

FIG. 5 depicts a schematic 500 of a second stage converter of a high-temperature ultra-low ripple multi-stage LED driver circuit.

As shown, the second stage 530 has two inputs electrically connected to the first stage via the first terminal 422 and via the second terminal 424, respectively. Also shown is an inductor and a second stage controller 555. Second stage controller 555 switches the FET in the second stage such that the LED current is regulated with minimum ripple. The terminals of a capacitor 540 are connected to the first terminal 422 and to the second terminal 424. The second stage produces a driving voltage across the two driving terminals (e.g., the first driving terminal 522 and the second driving terminal 524). The driving voltage powers the LEDs for the lamp. Although a buck circuit is shown here as an example, other converter types can also apply.

Finally, it should be noted that there are alternative ways of implementing the embodiments disclosed herein. Accordingly, the present embodiments are to be considered as illustrative and not restrictive, for example, the flexible printed circuit board can change to a rigid PCB, and the claims are not to be limited to the details given herein, but may be modified within the scope and equivalents thereof.

Figure 6:
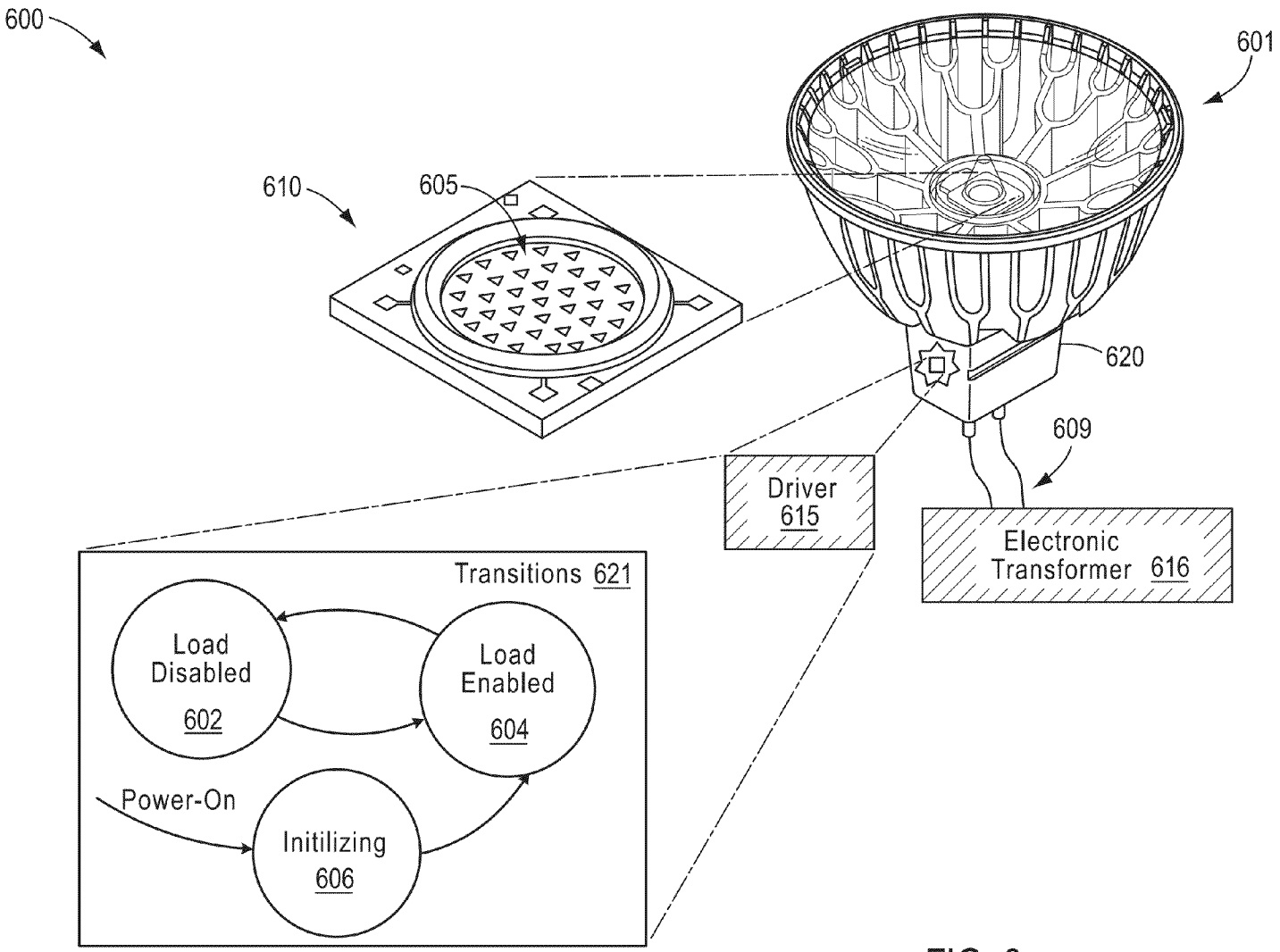
FIG. 6 depicts an LED lamp including a driver-based implementation of a preloading circuit in an LED lamp, according to some embodiments.

FIG. 6 depicts an LED lamp 600 including a driver-based implementation of a preloading circuit in an LED lamp.

As shown, an LED lamp 601 is connected using conductors 609 to an electronic transformer 616. The LED lamp comprises a base 620 that creates a volume, within which volume a driver 615 can be disposed. The LED lamp further comprises one or more LEDs, which LEDs might be organized into an LED array 605, and might be situated on a mechanical carrier 610.

The shown driver implements one or more techniques to perform transitions 621. For example, transitions 621 responds to application of power (see power-on transition) by initializing 606, then transitioning to temporarily present a load (see load enabled 604). The load can be continuously presented for a duration, then transition to a state where the load is no longer presented (see load disabled 602). The transitions from a state when a temporary load is presented (see the state labeled load enabled 604) to a state when the temporary load is removed (see load disabled 602) or vice-versa can occur under various conditions. For example, the transition to a state when a temporary load is presented (see load enabled 604) can occur responsive to power-on and completion of any initializing phase 606, which may comprise one or more sub-states. Or, in certain situations, the transition to a state when a temporary load is disabled (see the load disabled state 602) can occur responsive to a time delay, or a cycle count, or a measured voltage.

Figure 7A:
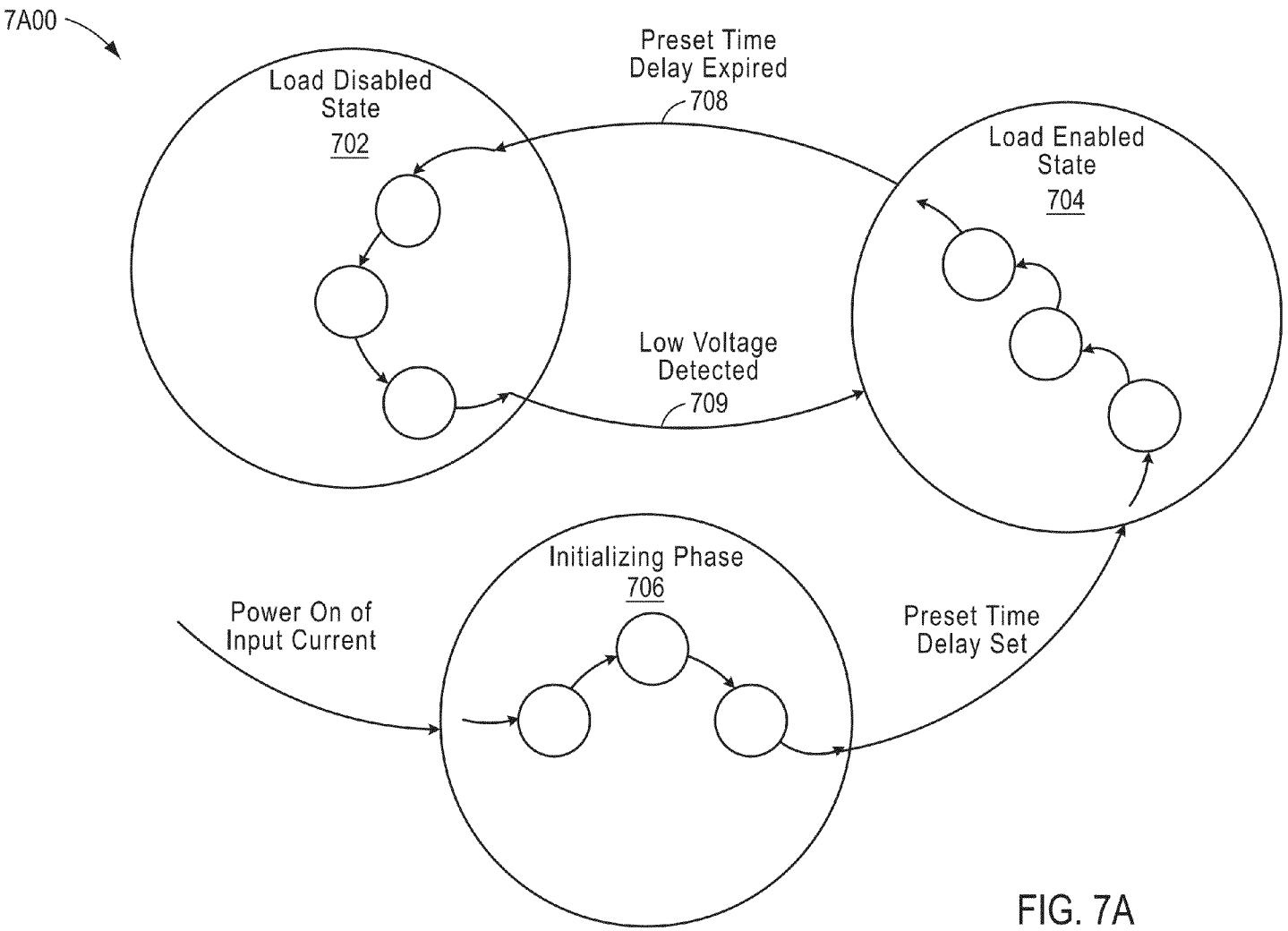
FIG. 7A is a state diagram showing preset time transitions as implemented by a preloading circuit in an LED lamp, according to some embodiments.

FIG. 7A is a state diagram 7A00 showing preset time transitions as implemented by a preloading circuit in an LED lamp.

In this embodiment, a phase for initializing (e.g., initializing phase 706) is entered upon power-on. The initializing phase may include sub-states. The load-enabled state 704 is entered after establishing a preset time delay. The preset time delay can be specified as an absolute time delay, or as a time delay occurring from counting half cycles of the input current.

After setting the preset time delay, the load-enabled state 704 is entered. The load-enabled state 704 may include sub-states. The load enabled state 704 or its sub-states count down or otherwise detect the expiration of the preset time delay (e.g., see preset time delay expired 708), and the state transitions to load disabled state 702. The load-disabled state 702 may include sub-states. The load disabled state 702 or its sub-states can detect a voltage (e.g., low voltage detected 709) and can transition back to the load enabled state 704, which would apply a load so as to keep the electronic transformer operating normally.

Figure 7B:
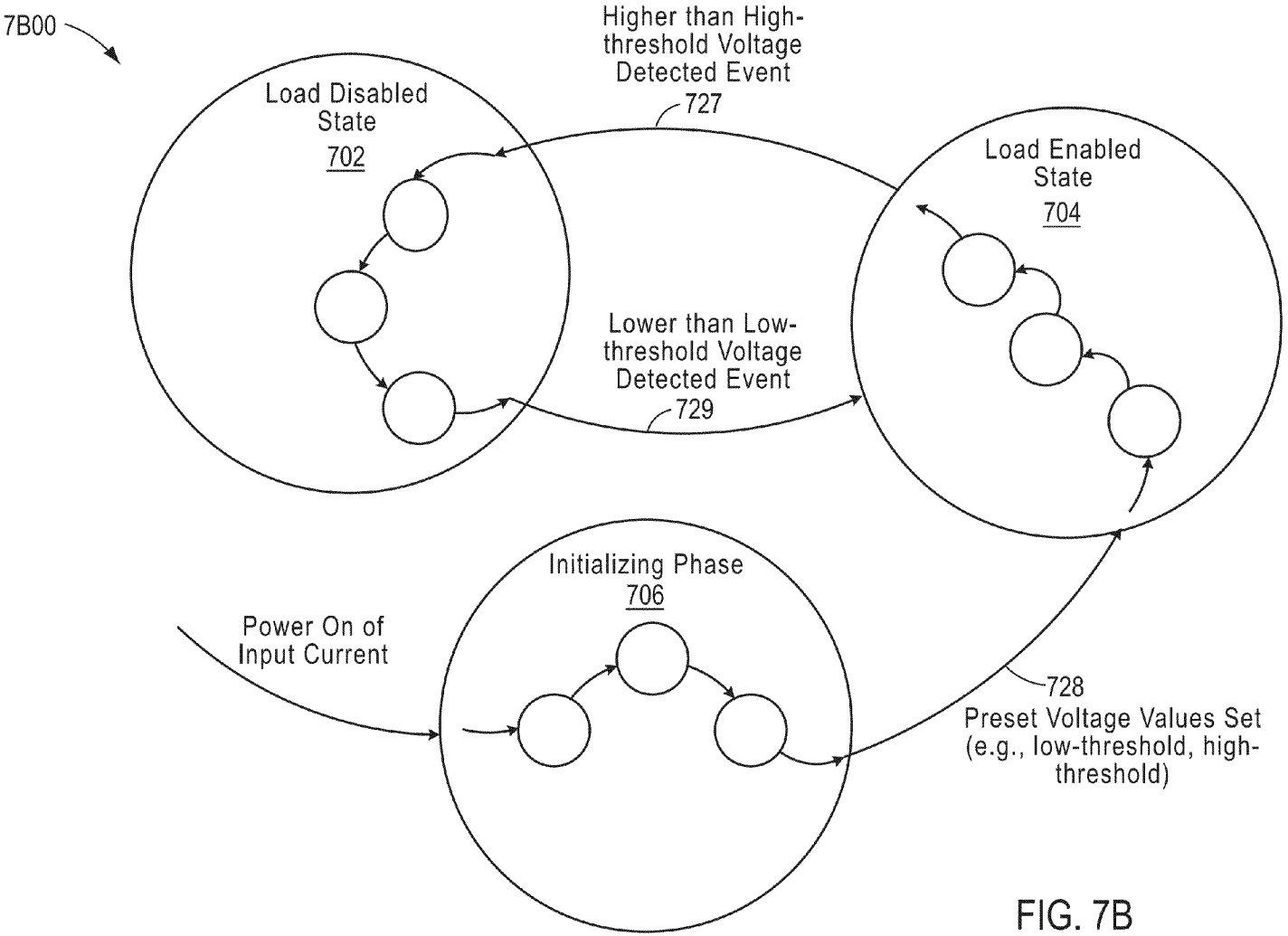
FIG. 7B is a state diagram showing voltage threshold transitions as implemented by a preloading circuit in an LED lamp, according to some embodiments.

FIG. 7B is a state diagram 7B00 showing voltage threshold transitions as implemented by a preloading circuit in an LED lamp.

In this embodiment, a phase for initializing (e.g., initializing phase 706) is entered upon power-on. The load enabled state 704 is entered after establishing preset voltage values (e.g., see event of preset voltage values set 728). The preset voltage values can be specified as an absolute voltage or as a derived quantity based at least in part on some aspect of the input current.

After setting the preset voltage values, the load enabled state 704 is entered. The load enabled state 704 or its sub-states detect voltages (e.g., voltage variations or absolute voltages) and move to a load disabled state 702 when a higher than high-threshold voltage is detected (e.g., see higher than high-threshold voltage detected event 727). The load disabled state 702 or its sub-states can detect a voltage (e.g., low voltage detected 709) and can transition back to the load enabled state 704, which would again apply a load so as to keep the electronic transformer operating normally. More particularly, a low voltage detection event (e.g., lower than low-threshold voltage detected event 729) can transition to the load enabled state 704.

Figure 8A:
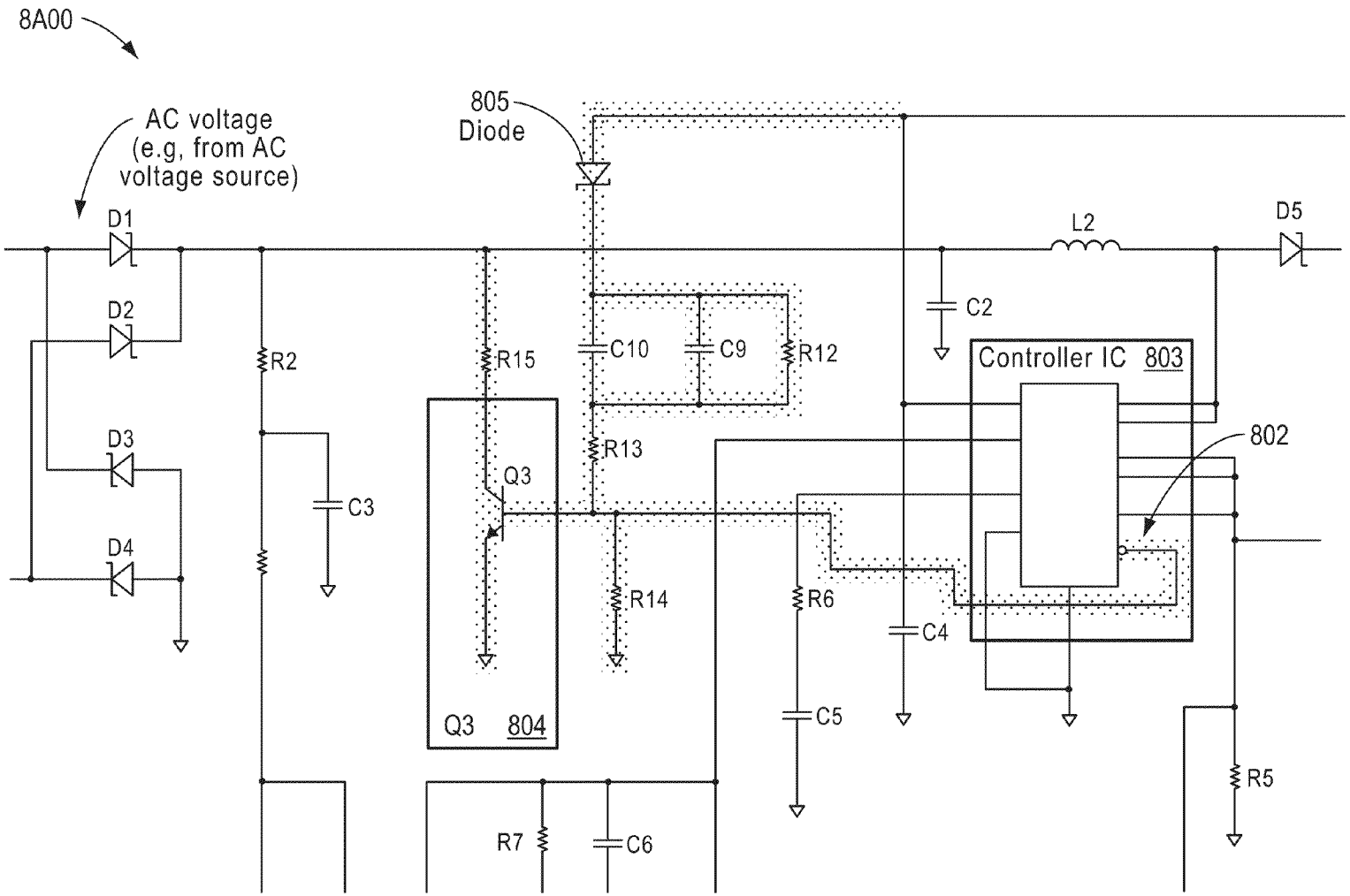
FIG. 8A, FIG. 8B, and FIG. 8C are schematics of portions of an LED driver including a portion for implementing alternative embodiments of a preloading circuit in an LED lamp, according to some embodiments.
Figure 8B:
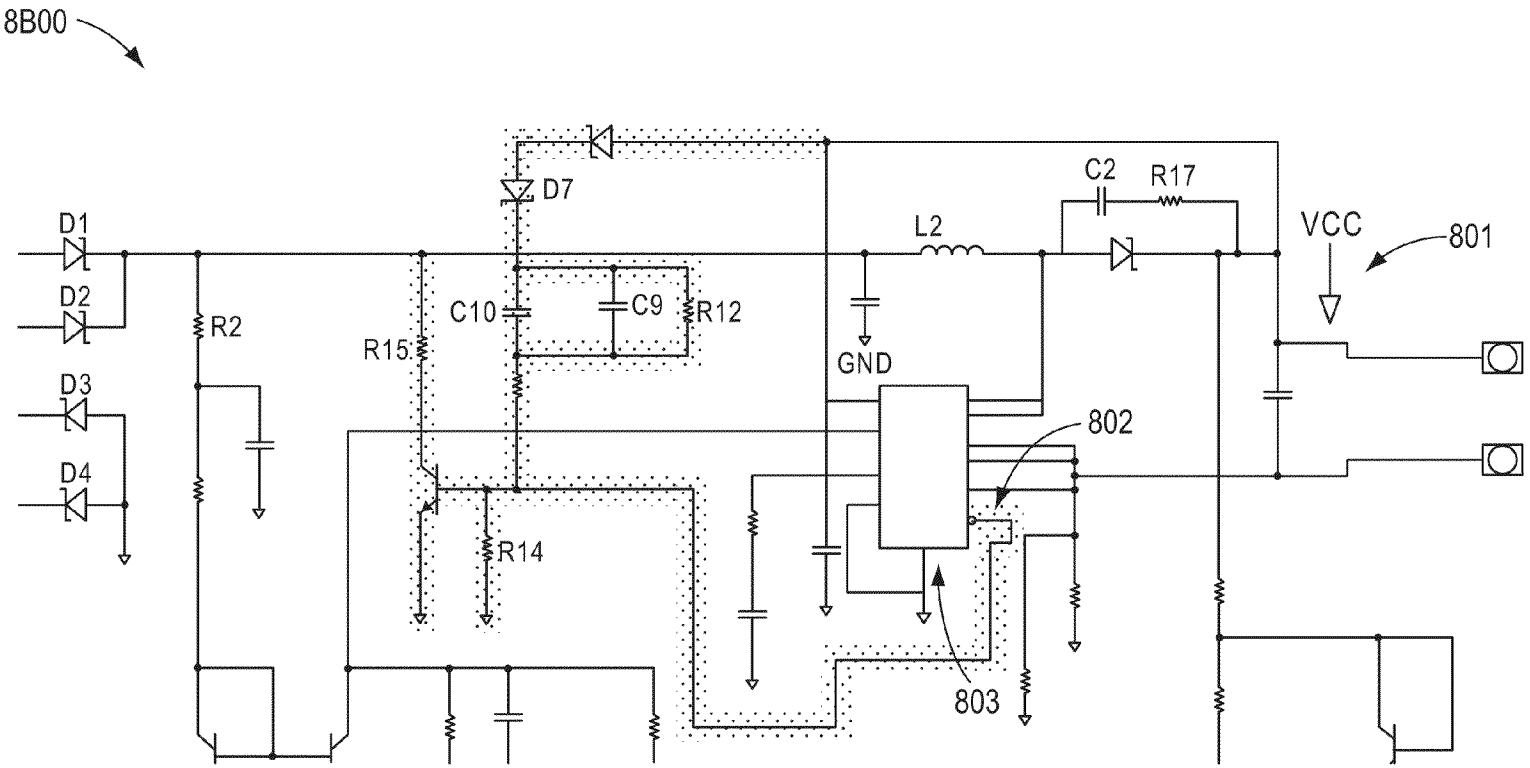
Figure 8C:
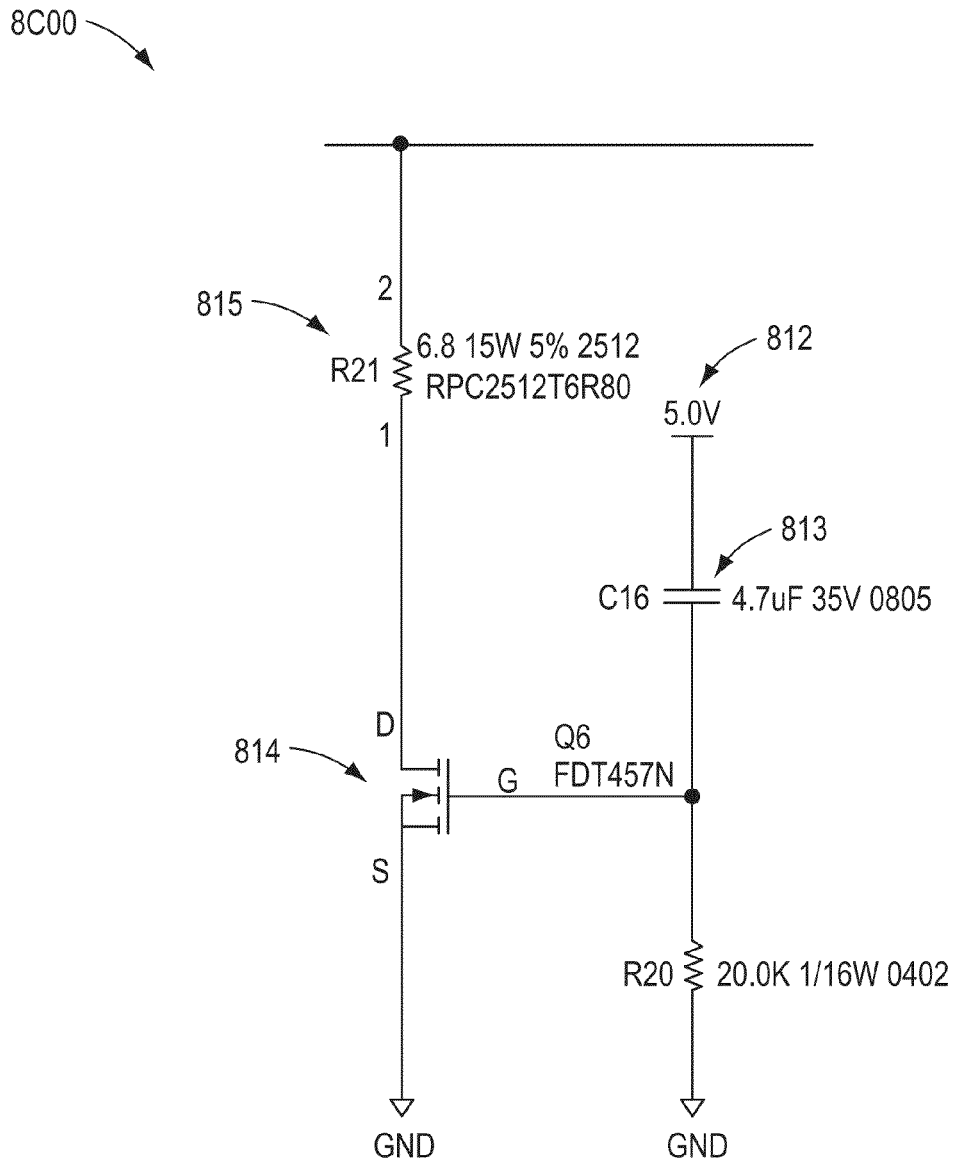

FIG. 8A, FIG. 8B, and FIG. 8C are schematics (e.g., schematic 8A00, schematic 8B00, and schematic 8C00) of portions of an LED driver including a portion for implementing alternative embodiments of a preloading circuit in an LED lamp.

The shown schematics present a start-up circuit as it applies to an MR16 LED lamp product (e.g., in an MR16 form factor). The depicted circuit operates as follows:

As the first voltage builds up (e.g., on Vcc 801 of schematic 8B00) at or after power turn on, a current source at a pin (e.g., pin 802) of the controller IC 803 sends a minimum of 12 mA to the base of Q3 804, based on {Vbe=0.7 volts, R14=200 ohms, and current is Vbe/R14=3.5 mA}. The base current from the controller IC will receive a minimum 12 mA minus 3.5 mA=8.5 mA. The transistor Q3, biased on, will load through R15, with the lamp input fed by the electronic transformer.

This base current lasts until the controller IC starts switching a short time later. Then the controller shuts off the current source.

After that the base current is continued and increases with the rising output voltage pumping current through diode D6 (see diode 805), capacitance C9 C10, and resistor R13. When C9, C10 are charged to the output voltage minus V diode, the base current has stopped and the circuit should not load the lamp input any more as long as the lamp output voltage stays high.

In some embodiments, certain components can be specified to have ranges and values as below:

There is a discharge resistor R12 for C9, C10 of 49.9K ohm. It has a time constant of 49.9K ohm×20 μF=1 second. This approximates how much time is needed to discharge C9, C10 through R12 after the output goes down. Capacitors C9, C10 discharge partially in order to cause the circuit to be ready for another lamp start.

The divider formed by the discharge resistor R12 with R13 and R14×Vcc in the steady state is intended to be much less than the forward bias voltage of the base emitter of transistor Q3. For example, the maximum voltage on the output is 48 volts. Dividing down, 48 volts×200/(200+1.0K+49.9K) =0.19 volt.

Given a frequency of 100 Hz, capacitors C9, C10 have less than 10 ms to discharge before they are charged again. The ripple at this frequency will not allow C9, C11 to discharge enough for base current to flow again on the 100 Hz output voltage upswings.

A 2010 size resistor can be specified for R15 to absorb about 15 watts average during a 30 ms preload.

Capacitors C9, C10 can be specified to be 50V parts to allow to be charged up to 48 volts as in a fault situation.

Q2 in this embodiment is specified to carry up to 3 A for 30 ms, and to have a 30 volt max Vice rating.

Diode D5 can be a 60V 0.5 A diode in order to prevent discharge of C9, C10 into the output.

As depicted in schematic 8C00. Application of the 5 volt supply 812 starts to charge the capacitor 813. Before capacitor 813 is fully charged up, the FET 814 is in the "on" state, thus enabling preload resistor 815 into the circuit. When the capacitor 813 is fully charged up, it turns off FET 814 removing the preload resistor 815 from the circuit.

Figure 9:
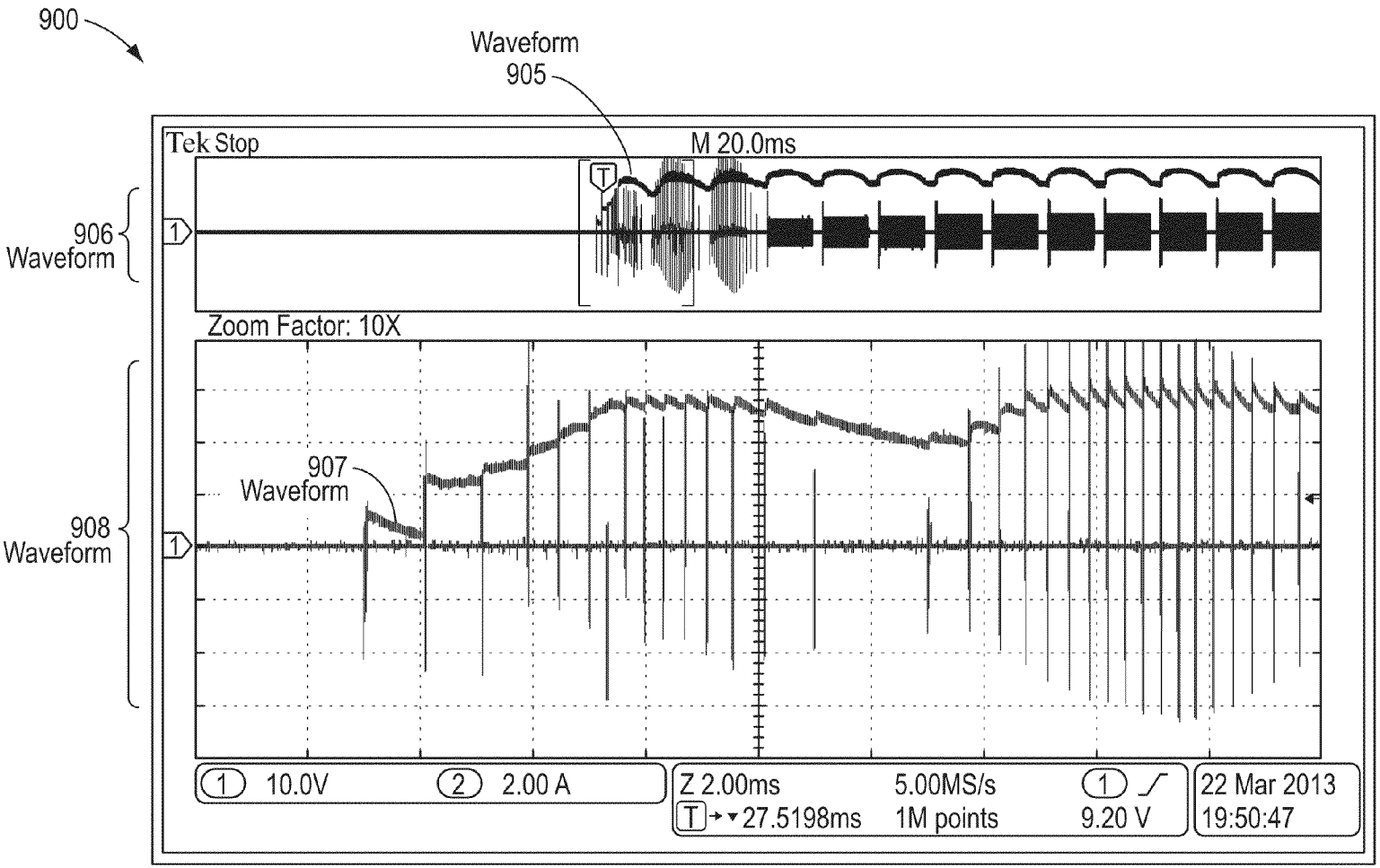
FIG. 9 is a trace of an LED lamp startup situation that needs a preloading circuit, according to some embodiments.

FIG. 9 is a trace 900 of an LED lamp startup situation that needs a preloading circuit. The electronic transformer delivers a high current into the bridge rectifier of the lamp, charging up the front end for a pulse or two. This specific embodiment depicts an MR16 12-watt startup scenario, showing traces (waveform 905 and waveform 907). Waveform 906 and waveform 908 are lamp input current traces. The next voltage pulses do not deliver much current, and the electronic transformer oscillator stops. Restart attempts occur every 0.3 to 1.0 ms. Normal operation might begin or might not.

This trace 900 shows the situation where the lamp might or might not get going. In this situation, waveform 905 and waveform 907 show the lamp output voltage at two zoom factors, respectively, and waveform 906 and waveform 908 show the lamp input voltage at two zoom factors. The waveforms of FIG. 9 can be compared with the waveforms of FIG. 5.

Figure 10:
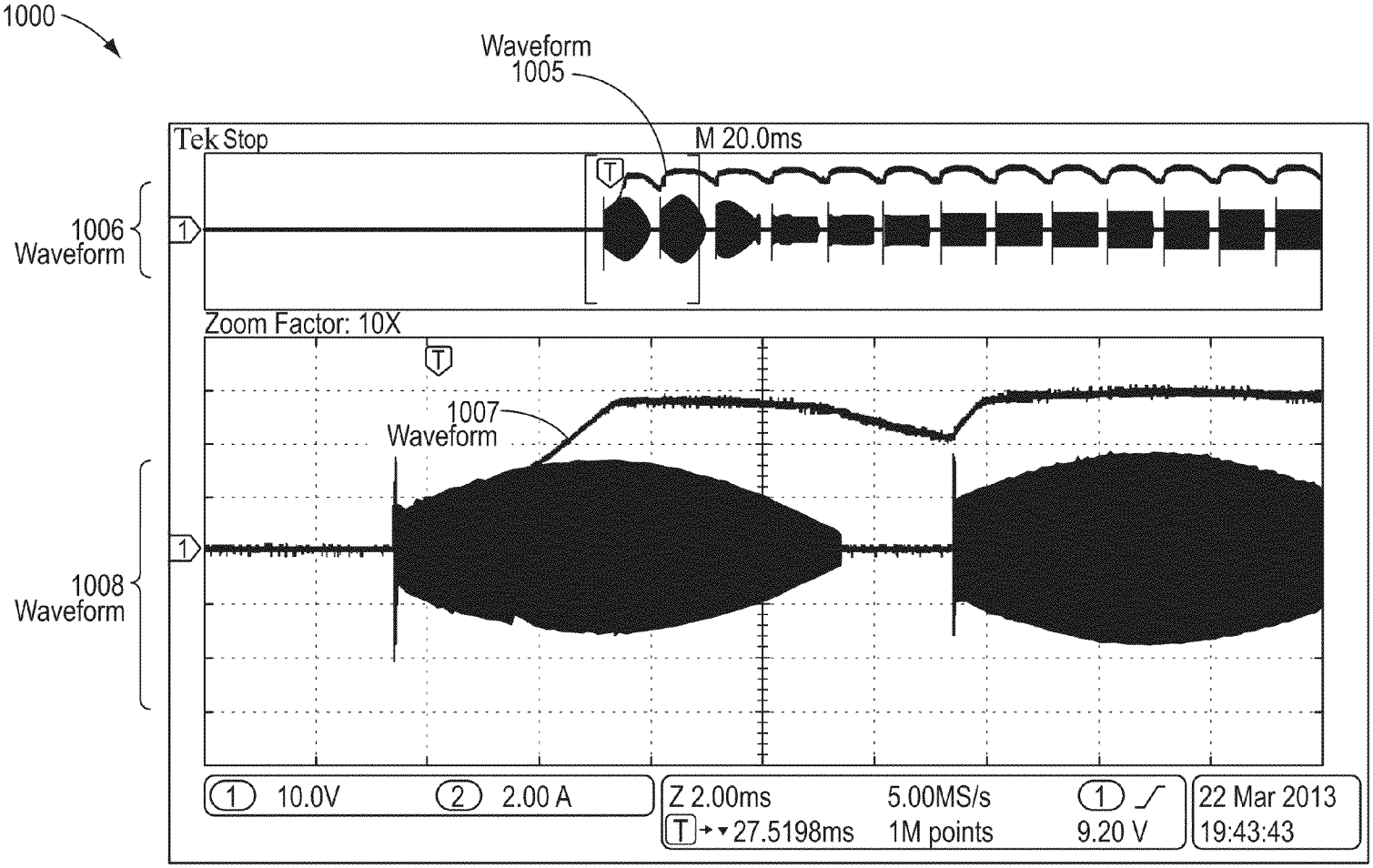
FIG. 10 is a trace of a startup situation when using a preloading circuit in an LED lamp, according to some embodiments.

FIG. 10 is a trace 1000 of a startup situation when using a preloading circuit in an LED lamp.

The trace 1000 shows operation when using a preloading circuit in an LED lamp. This trace depicts the specific case of an MR16 12-watt startup scenario, and shows traces (waveform 1005 and waveform 1007) showing lamp output voltage over time. Waveform 1006 and waveform 1008 are lamp input current traces. The trace 1000 shows the effect of the preloading circuit, which is normal operation during this loading scenario. The trace also shows waveforms after this load is removed.

Specifically, waveform 1005 and waveform 1007 show the lamp output voltage at a two zoom factors, respectively, and waveform 1006 and waveform 1008 show the lamp input voltage at zoom factors, respectively.

Figure 11:
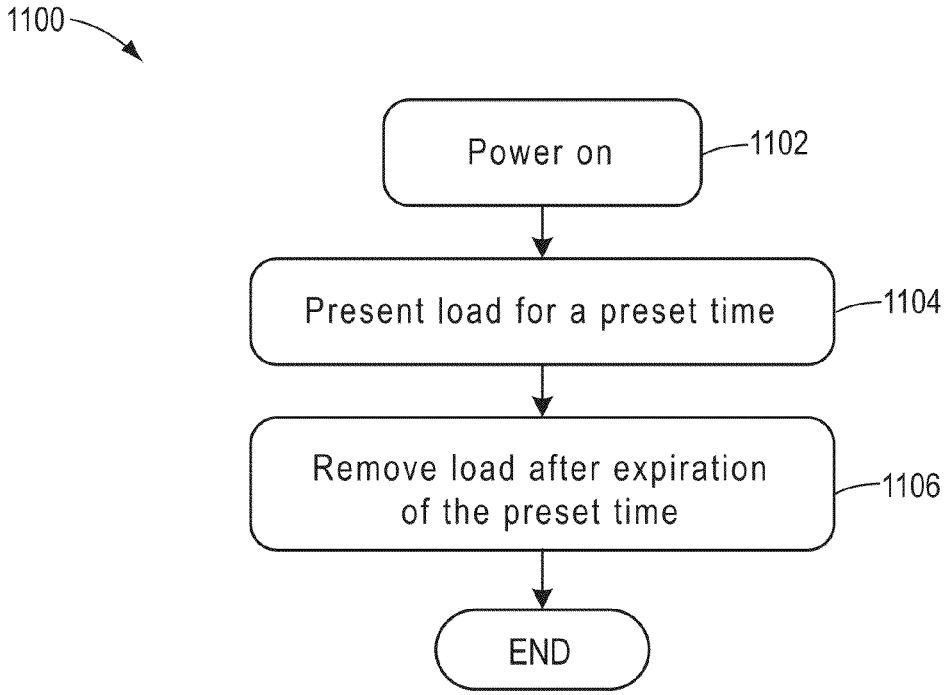
FIG. 11 is a flow diagram for implementing preset time transitions in a preloading circuit in an LED lamp, according to some embodiments.

FIG. 11 is a flow diagram 1100 for implementing preset time transitions in a preloading circuit in an LED lamp.

The system shown in flow diagram 1100 commences with a power on event (e.g., power on 1102) followed by presenting a load for a certain time period (e.g., see operation to present load for a preset time 1104). Later, the load is removed (see operation to remove load after expiration of the preset time 1106).

Figure 12:
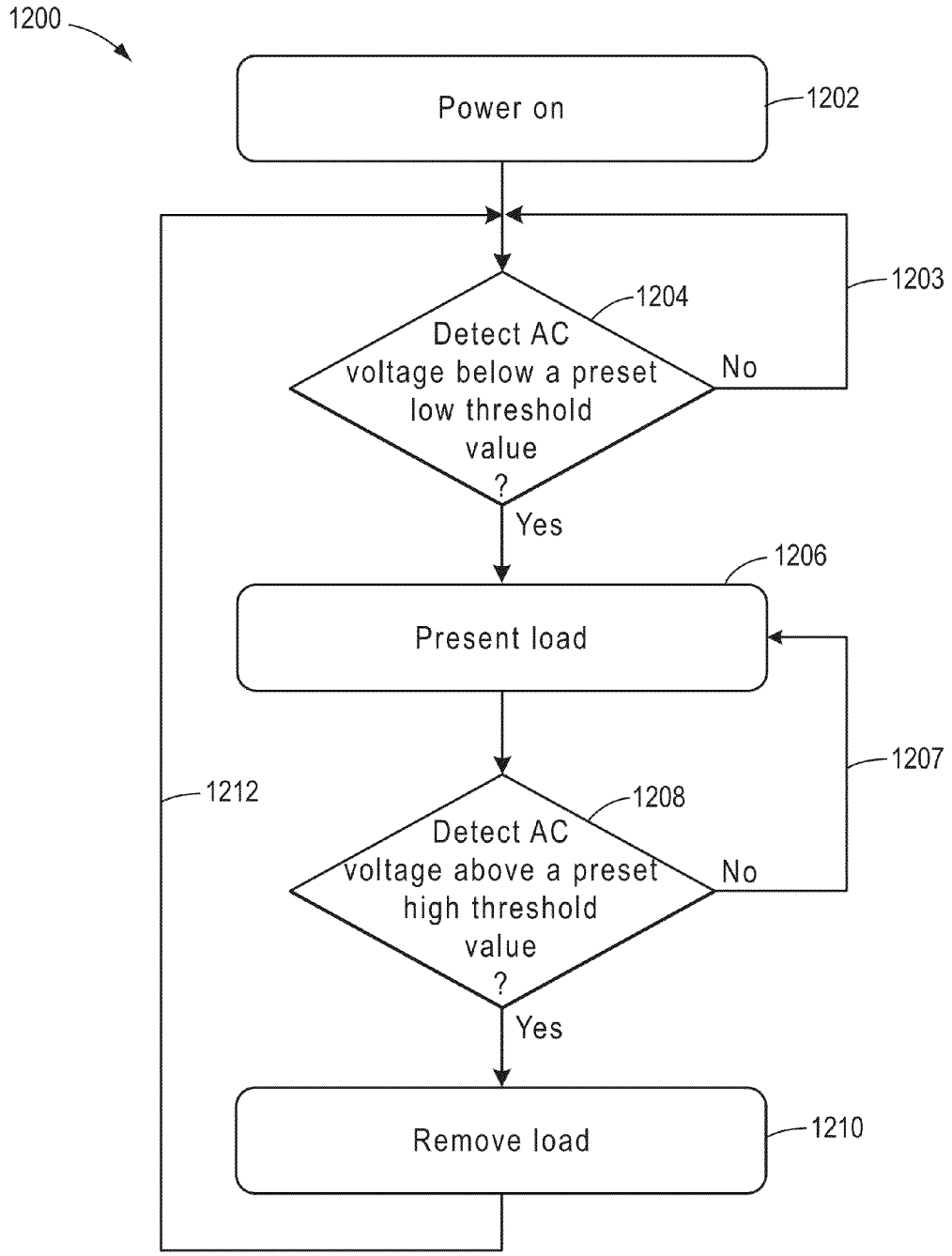
FIG. 12 is a flow diagram for implementing voltage threshold transitions in a preloading circuit in an LED lamp, according to some embodiments.

FIG. 12 is a flow diagram 1200 for implementing voltage threshold transitions in a preloading circuit in an LED lamp.

The system shown in flow diagram 1200 commences with a power-on event (e.g., see power on 1202) followed by a loop 1203 to check if a voltage is below a preset low threshold value (e.g., see decision 1204). When the voltage is below a preset threshold then a load is presented (e.g., see operation 1206). Then, the flow proceeds to another loop 1207 to check if a voltage is above a preset high threshold voltage (e.g., see decision 1208). When the voltage is above a preset high threshold value, then the load is removed (e.g., see operation 1210), which load may be removed possibly after a controlled delay. The flow cycles back to decision 1204 via return path 1212, which decision includes an operation to check if a voltage is below a preset low threshold value (e.g., see decision 1204).

In this manner, a load can be presented as needed to keep the electronic transformer in normal operation.

A wide range of embodiments are possible and felicitous, including the embodiments below.

Embodiment 1

An LED lamp for connecting to an alternating voltage source, the LED lamp comprising: a pair of input power conductors connected to an electronic transformer; a voltage regulation circuit, the voltage regulation circuit comprising; a pair of inputs electrically connected to the input power conductors; a loading circuit to form a regulated voltage output; and at least one light emitting diode, the light emitting diode electrically connected to the at least one regulated voltage outputs; wherein the loading circuit presents a load at the input power conductors during a first period and removes the load at the input power conductors during a second period.

Embodiment 2

The LED lamp of Embodiment 1, wherein the first period begins upon a power-on event, and the second period begins after three half cycles of the alternating voltage source after the power-on event.

Embodiment 3

The LED lamp of Embodiment 1, wherein the second period is followed by a third period beginning upon detection of a low voltage event.

Embodiment 4

The LED lamp of Embodiment 1, where the LED lamp is an MR16 form factor.

Embodiment 5

An LED lamp for connecting to an alternating voltage source, the LED lamp comprising: a pair of input power conductors connected to an electronic transformer; a voltage regulation circuit, the voltage regulation circuit comprising a pair of inputs electrically connected to the input power conductors; a loading circuit; at least one regulated voltage output; and at least one light emitting diode, the light emitting diode electrically connected to the regulated voltage outputs;

wherein the loading circuit presents a load at the input power conductors after detecting a lower than a preset low threshold voltage event at the input power conductors and removes the load at the input power conductors after detection of a higher than a preset high threshold voltage event at the input power conductors.

Embodiment 6

The LED lamp of Embodiment 5, wherein preset low threshold voltage is a voltage determined by the electronic transformer's removal of AC output voltage.

Embodiment 7

The LED lamp of Embodiment 5, wherein preset high threshold voltage is a voltage determined by restoration of the AC voltage by the electronic transformer.

Embodiment 8

An LED array for connecting to an alternating voltage source, the LED array comprising a pair of input power conductors connected to an electronic transformer; a voltage regulation circuit, the voltage regulation circuit comprising; a pair of inputs electrically connected to the input power conductors; a loading circuit; at least one regulated voltage output; and at least one light emitting diode, the light emitting diode electrically connected to the at least one regulated voltage outputs; wherein the loading circuit presents a load at the input power conductors during a first period and removes the load at the input power conductors during a second period.

Embodiment 9

The LED array of Embodiment 8, wherein the first period begins upon a power-on event, and the second period begins after three half cycles of the alternating voltage source after the power-on event.

Embodiment 10

The LED array of embodiment 8, wherein the second period is followed by a third period beginning upon detection of a low voltage event.

Figure 13A:
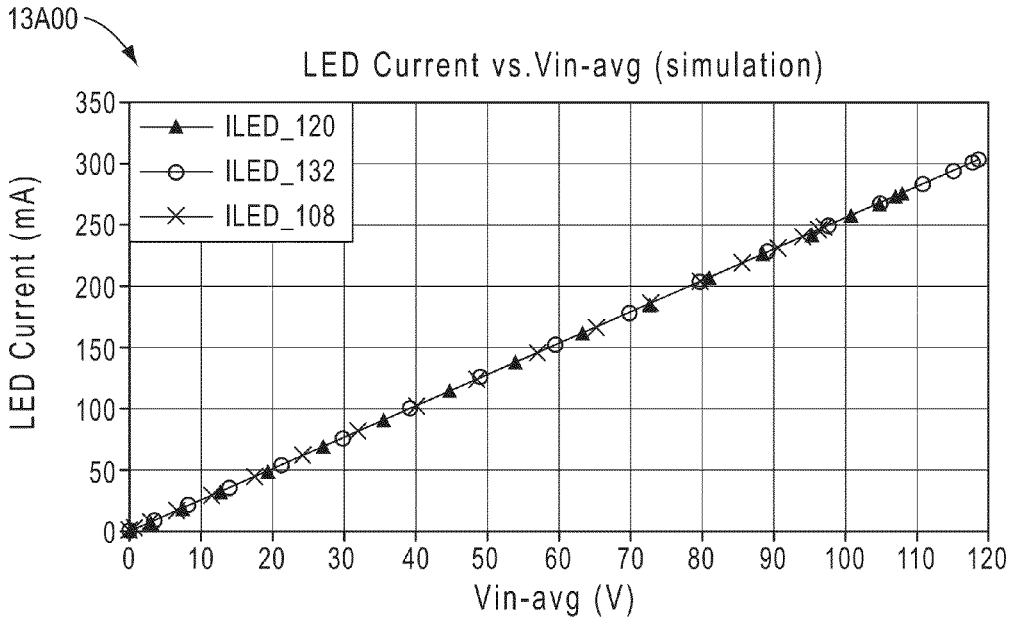
FIG. 13A depicts time-variation in LED dimming current as a function of voltage input.

FIG. 13A depicts time-variations in LED dimming current 13A00 as a function of voltage input. As shown, the output current (e.g., LED current) varies nearly linearly with voltage in. While this behavior is used in legacy dimming circuits where LED current is varied over a narrow range, it has the drawback that a single function (e.g., such as is shown in FIG. 13A) generates a very high LED current when driven by one voltage (e.g., the 220 Volt AC line voltage as is used in many European and Asian countries) as compared with a much lower LED current when driven by a different voltage (e.g., the 110 Volt AC line voltage as is used in North American countries). The variation in LED dimming current as a function of voltage input compares and contrasts with variations in LED dimming current as a function of duty cycle, which comparisons and contrasts are shown and discussed in FIG. 13B.

Figure 13B:
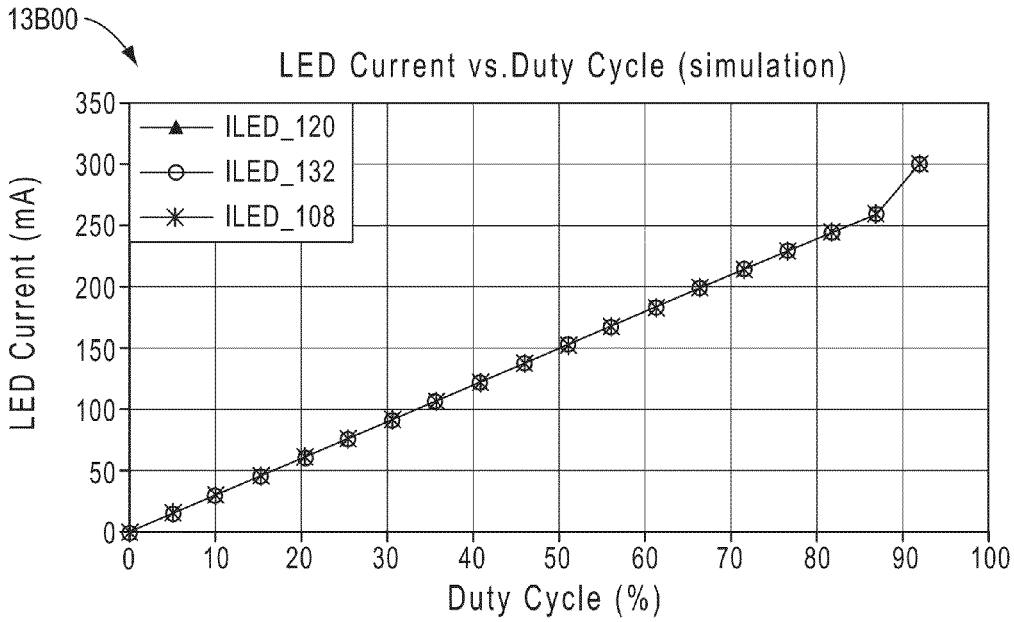
FIG. 13B depicts time-variation in LED dimming current as a function of duty cycle, according to some embodiments.

FIG. 13B depicts time-variations in LED dimming current 13B00 as a function of duty cycle, according to some embodiments.

As an observation, the duty cycle of the AC line voltage, regardless of the voltage standard or country, is nearly constant at 50%. Thus, a reference voltage circuit based on duty cycle can be used in any country, under extremely different line voltage circumstances, and the downstream dimming circuits can be designed to rely on a dimming voltage. A circuit to produce an LED dimming voltage based on duty cycle is shown and discussed in FIG. 14.

Figure 14:
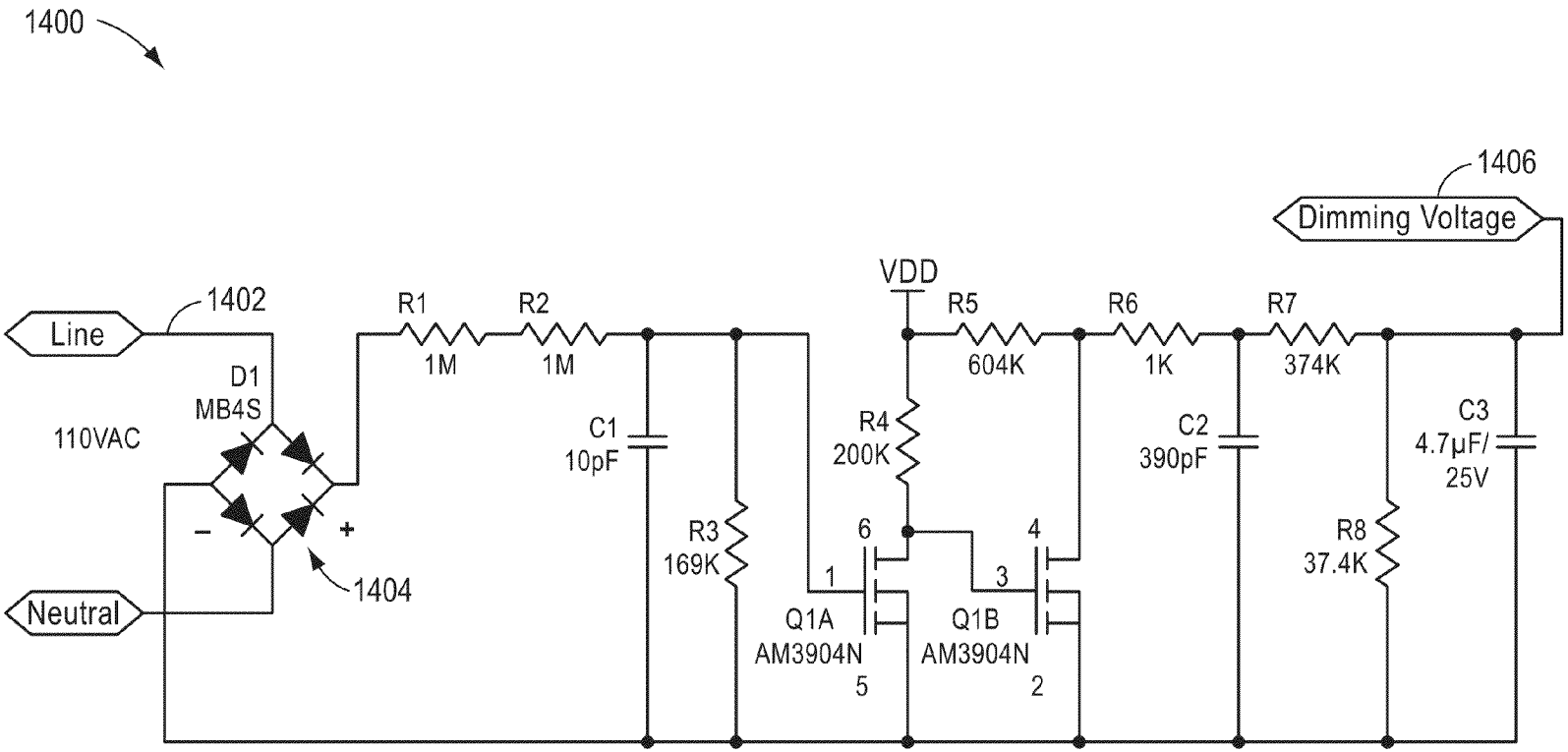
FIG. 14 is a schematic drawing of a dimming circuit duty-cycle to produce an LED dimming voltage, according to some embodiments.

FIG. 14 is a schematic drawing of a dimming circuit based on duty-cycle 1400 as used to produce an LED dimming voltage, according to some embodiments.

As shown, a line voltage 1402 supplies a potential to a bridge 1404 to produce a full-wave rectified waveform. The right portion of the circuit of schematic 1400 scales down the full-wave rectified waveform to produce the shown duty cycle-controlled dimming voltage. The duty cycle-controlled dimming voltage is used by dimming circuits (e.g., see FIGS. 15A and 15B, FIG. 16, and FIG. 17). The duty-cycle-controlled dimming voltage is generated in a manner independent from the particular country's line voltage.

Figure 15A:
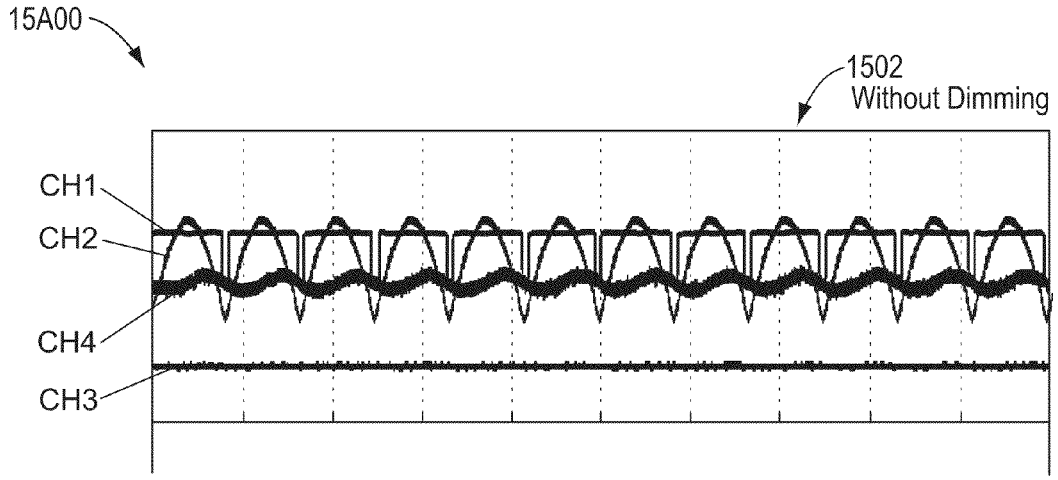
FIG. 15A and FIG. 15B are waveforms for comparison of the behavior of a non-dimming voltage versus the behavior of a dimming voltage based on duty cycle.
Figure 15B:
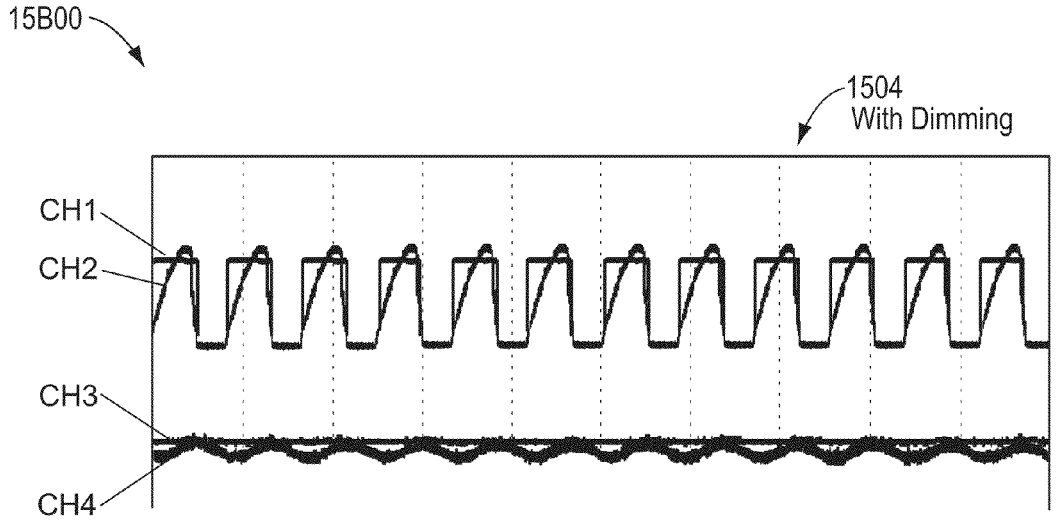

FIG. 15A and FIG. 15B are waveforms 15A00 and 15B00 for comparison of the behavior of a non-dimming voltage versus the behavior of a dimming voltage based on duty cycle.

As shown, in FIG. 15A, channel 1 CH1 is the duty-cycle circuit output, channel 2 CH2 the rectifier output voltage, channel 3 CH3 is the LED output voltage, and channel 4 CH4 is the output LED current. The duty cycle circuit presents the widest duty cycle corresponding to full brightness (e.g., without dimming).

In FIG. 15B, the duty cycle output is only about 60% of full, which commands a lower LED current, thus achieving a dimming brightness (e.g., with lower current), where the dimming current is dependent on the duty cycle (e.g., not directly dependent on the input voltage).

A wide range of embodiments are possible and felicitous, including the embodiments below.

Embodiment 11

A dimmable LED lamp comprises an AC/DC driver. The driver further comprises of a duty cycle conversion circuit. The duty cycle circuit output does not depend on lamp input voltage magnitude, and is at least partially dependent on information derived from the duty-cycle of an input voltage (e.g., a voltage from a dimmer).

Figure 16:
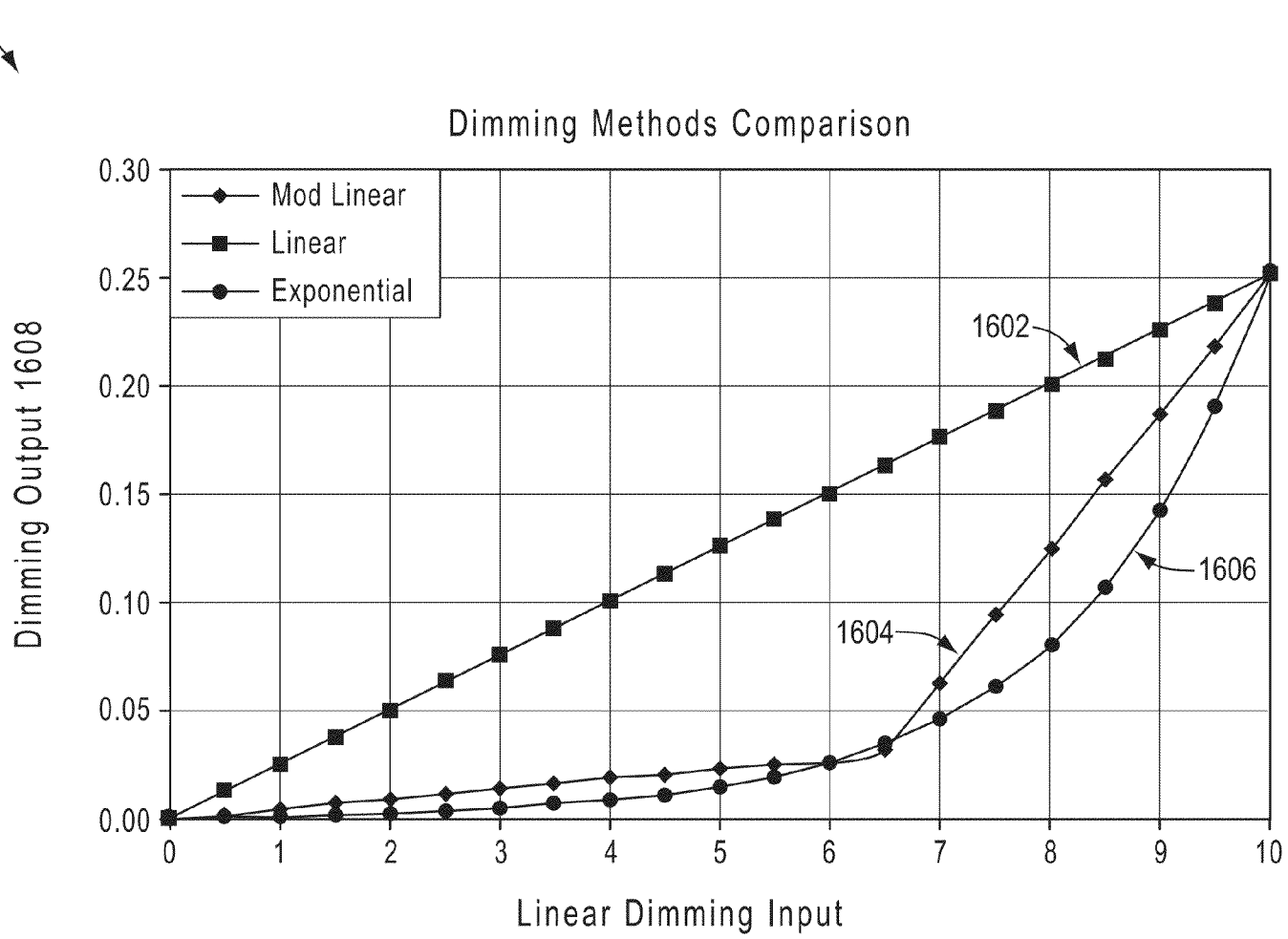
FIG. 16 depicts a comparison chart of various dimming curves including a modified linear dimming curve.

FIG. 16 depicts a comparison chart 1600 of various dimming curves including a modified linear dimming curve.

The comparison chart 1600 includes a single-segment linear dimming curve 1602, a logarithmic curve 1604, and a two-segment linear curve 1606. The single-segment linear dimming curve 1602 produces a dimming output 1608 that varies linearly over the dimming input range. Human perception, however, does not follow a linear response curve. Following a human perception model, desired shapes of dimming curves exhibit larger changes per increment at high brightness levels, and smaller changes per increment at low brightness levels.

To produce the larger changes per increment at high brightness levels and smaller changes per increment at low brightness levels, the logarithmic curve 1604 can be implemented using any known technique. Or, to produce the larger changes per increment at high brightness levels and smaller changes per increment at low brightness levels, a two-segment linear curve 1606 can be implemented using any known technique, such as for example, the circuit of FIG. 17.

Figure 17:
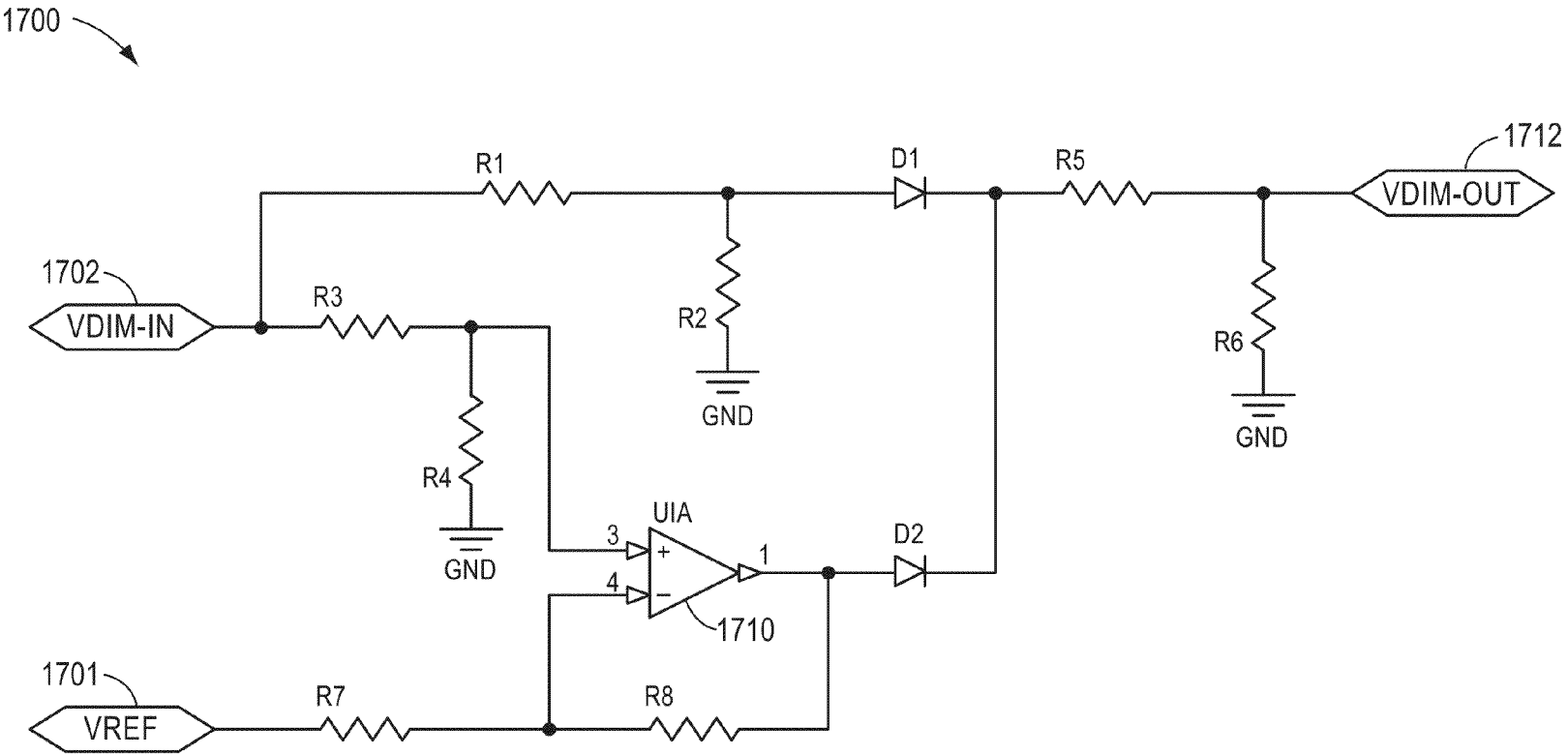
FIG. 17 depicts a schematic of a circuit to implement a modified linear dimming curve.

FIG. 17 depicts a schematic of a circuit to 1700 implement a modified linear dimming curve.

As shown, a VDIM-IN voltage 1702 presents a potential to operational amplifier 1710 (e.g., with respect to VREF 1701).

The circuit produces a VDIM-OUT 1712 potential that has a shape similar to the two-segment linear curve 1606 of FIG. 16.

A wide range of embodiments are possible and felicitous, including the embodiments below.

Embodiment 12

A LED lamp having a driver, where the driver circuit has two branches operating in parallel, where one branch operates to implement a first slope of a first segment, and a second branch operates to implement a second slope of a second segment. In one embodiment, the two branches operate to shape the LED current, the LED current being responsive to dimming voltage or a dimming command.

Figure 18:
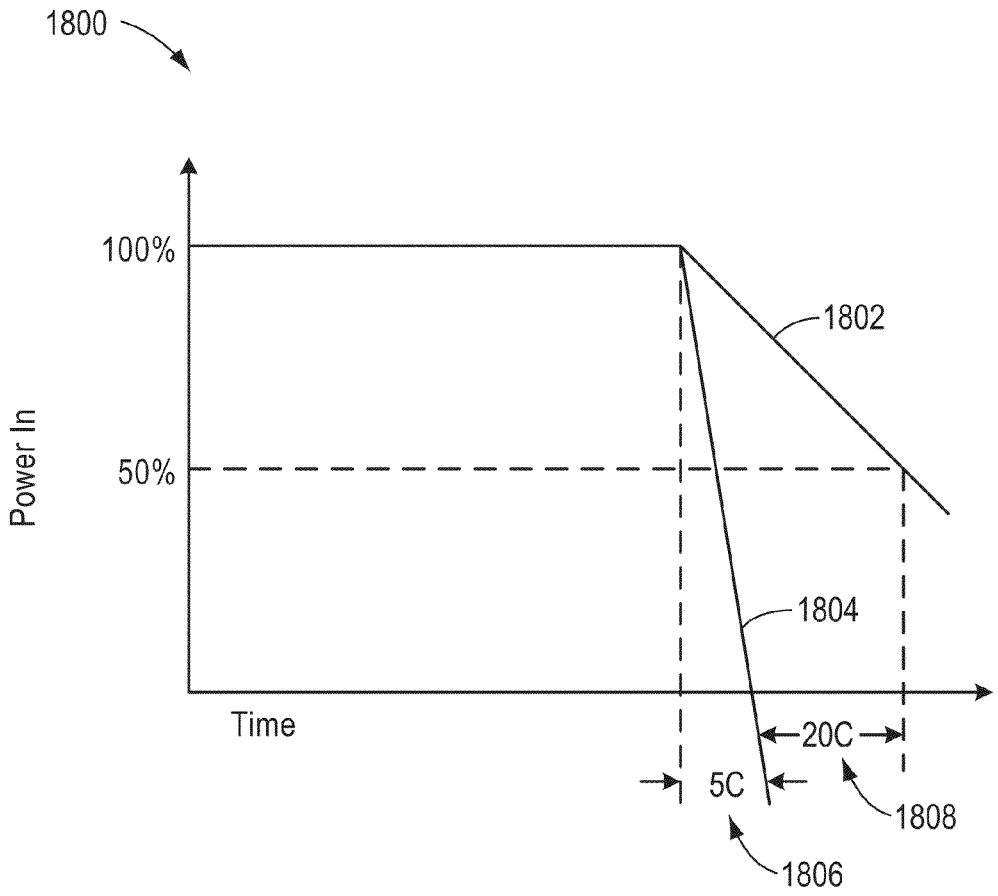
FIG. 18 depicts a chart showing input power fold back as a function of temperature.

FIG. 18 depicts a chart 1800 showing input power fold back as a function of temperature. In some cases droop is very pronounced (e.g., see droop curve 1084). In other cases droop is less pronounced (see droop curve 1802). Droop can occur in many situations, and in some cases, such as those described below, droop can be avoided.

Strictly as an illustrative example, high power LED lamps can overheat (e.g., in small fixtures, and/or when installed in high ambient temperature environments), and this can occur with or without dimming. One possibility to manage temperatures in the LED lamp and/or at or near lamp components is to detect excessive temperatures and then to reduce the power of the lamp to control the temperatures to a safe level. Using the foregoing temperature management technique, light output is configured to initially output at a maximum power (e.g., when the lamp is first turned on) and will be dimmed as the power is reduced to manage the lamp temperatures. This often results in observable droop, and in some applications such droop is out of spec and/or is objectionable to observers. Also, using the foregoing management technique there may be a noticeable light output change when the lamp is operated near ventilation ducts. In some such situations, the output of the lamp varies during operation of the climate control system. This often results in observable droop or other variations, and in some applications, such droop or other variations is out of spec and/or is objectionable to observers.

In some LED lamp designs the droop varies from a high output to a low output over a broad range of operating temperatures (see droop curve 1802). In other LED lamp designs the droop varies from a high output to a low output over a narrow range of operating temperatures (see droop curve 1804).

An alternative way to regulate the temperature is to keep the lamp at a safe operating temperature at all times without exceeding a given threshold temperature. When the lamp is turned-on, the lamp will "warm up", and once a safe and stable operating temperature is established (or predicted to be established), a power level value is stored in non-volatile memory. Thereafter, when the lamp is turned on, this operating power will be recalled and clamp the lamp's power to a power level value corresponding to the aforementioned safe thermal operating conditions. This technique serves to eliminate undesired droop, and this technique also addresses the issue of light variation due to ventilation system cycles and other ambient temperature variations.

If, during a power-on phase, the memorized initial power level is deemed to have been set too high, such as if the air conditioning was cooling the lamp during its initial "learning mode", then the technique (e.g., using a processor) can initiate a new learning mode. The new operating condition will be memorized or otherwise saved and will become the learned operating power. New learned operating power setting can be re-learned at various intervals. This temperature management technique (e.g., including managing unwanted dimming) can be implemented in a microprocessor, or in a dedicated circuit or in other ways, some examples of which implementations are discussed below.

Figure 19:
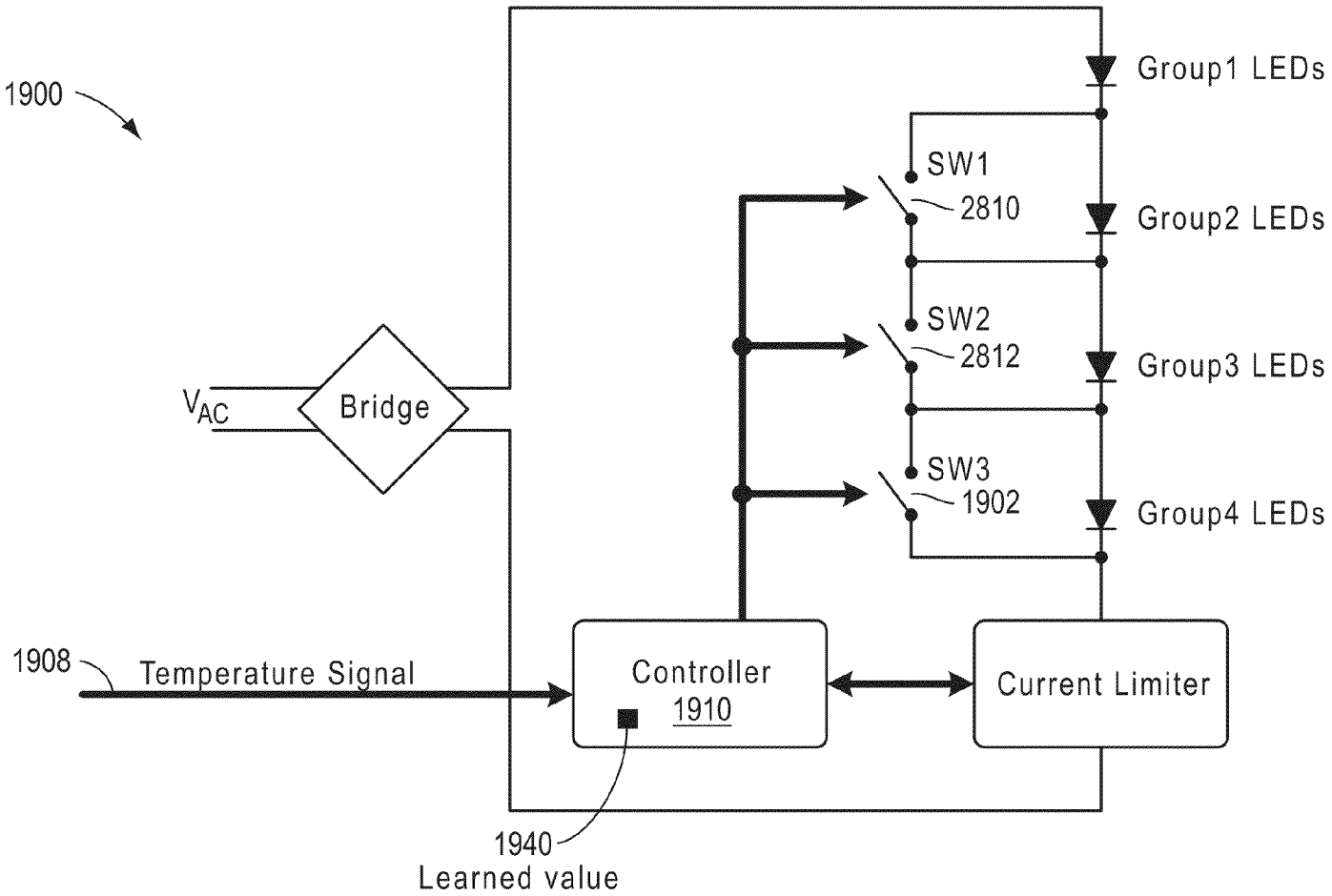
FIG. 19 is a block diagram of a microprocessor-based circuit for managing the temperature of an LED lamp, according to some embodiments.

FIG. 19 is a block diagram 1900 of a microprocessor-based circuit for managing the temperature of an LED lamp. In this example, the microprocessor performs the temperature management algorithm as described above. The controller 1910 saves the learned value 1940 upon an initial learning event. The learned value 1940 can hold a power level or a resistance level, or another value so as to modulate the temperature of the lamp (e.g., see temperature signal) within a known operating range. The microprocessor implementation of FIG. 19 is merely one way to practice the technique. Other possibilities that do not involve a microprocessor are presently discussed.

Embodiment 13

An LED lamp for connecting to an alternating voltage source, the LED lamp comprising: a pair of input power conductors connected to an alternating voltage source; a voltage regulation circuit, the voltage regulation circuit comprising, a pair of inputs electrically connected to the input power conductors; and a dimming circuit; wherein the dimming circuit changes the light output based on a predetermined curve.

The LED lamp of Embodiment 13, wherein the modified linear dimming curve is a modified linear dimming curve.

Figure 20:
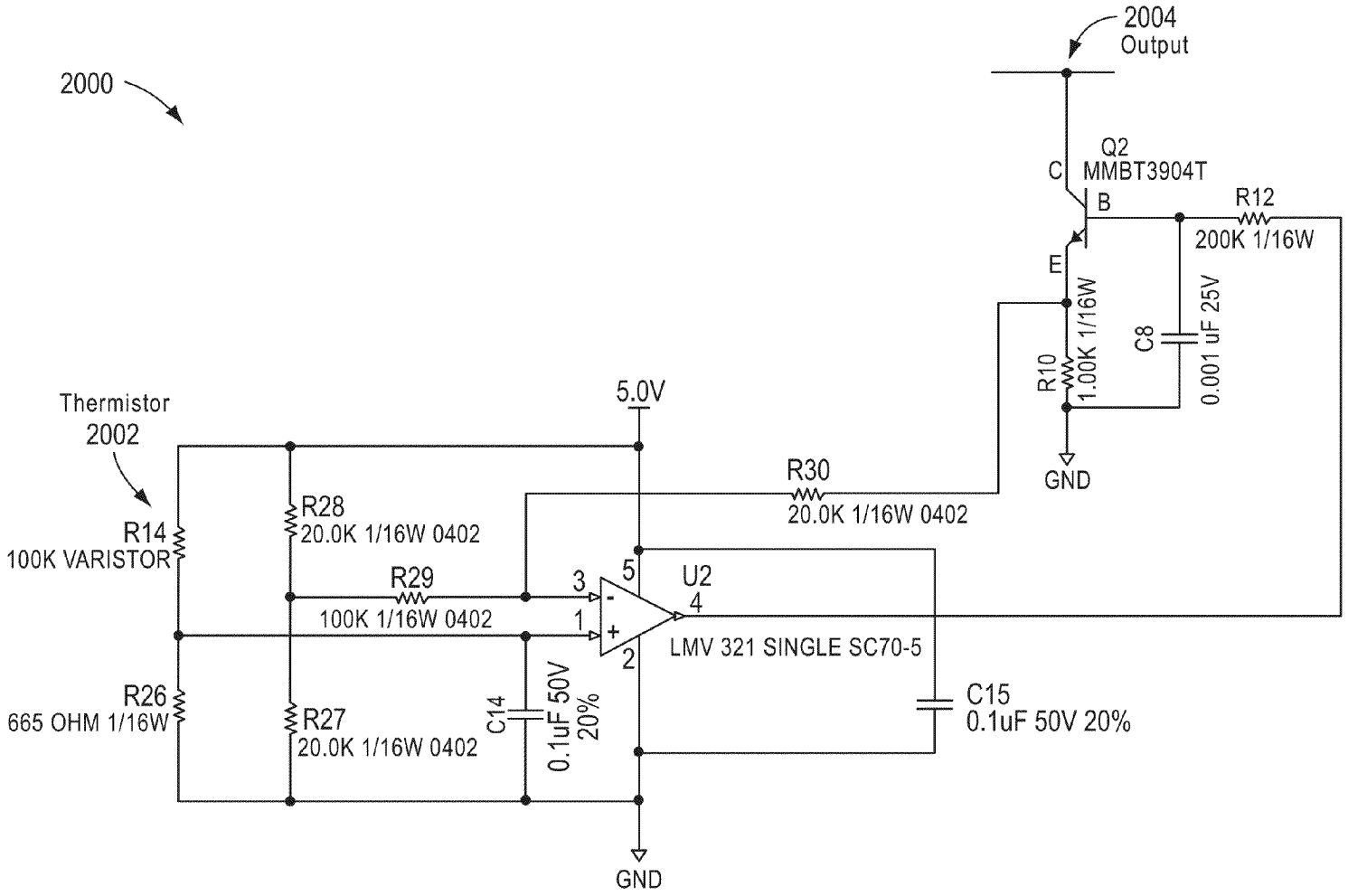
FIG. 20 shows a schematic of a circuit for managing the input power versus temperature of an LED lamp, according to some embodiments.

FIG. 20 shows a schematic 2000 of a circuit for managing the shape of input power versus temperature of an LED lamp, according to some embodiments.

The circuit uses an operational amplifier (high gain) to amplify the signal generated by the thermistor to control the LED current reference (see output 2004). The circuit shown serves to control the brightness within a temperature range. The maximized brightness operating temperature can be set as high as possible so as to maintain maximum brightness levels without overheating.

Figure 21:
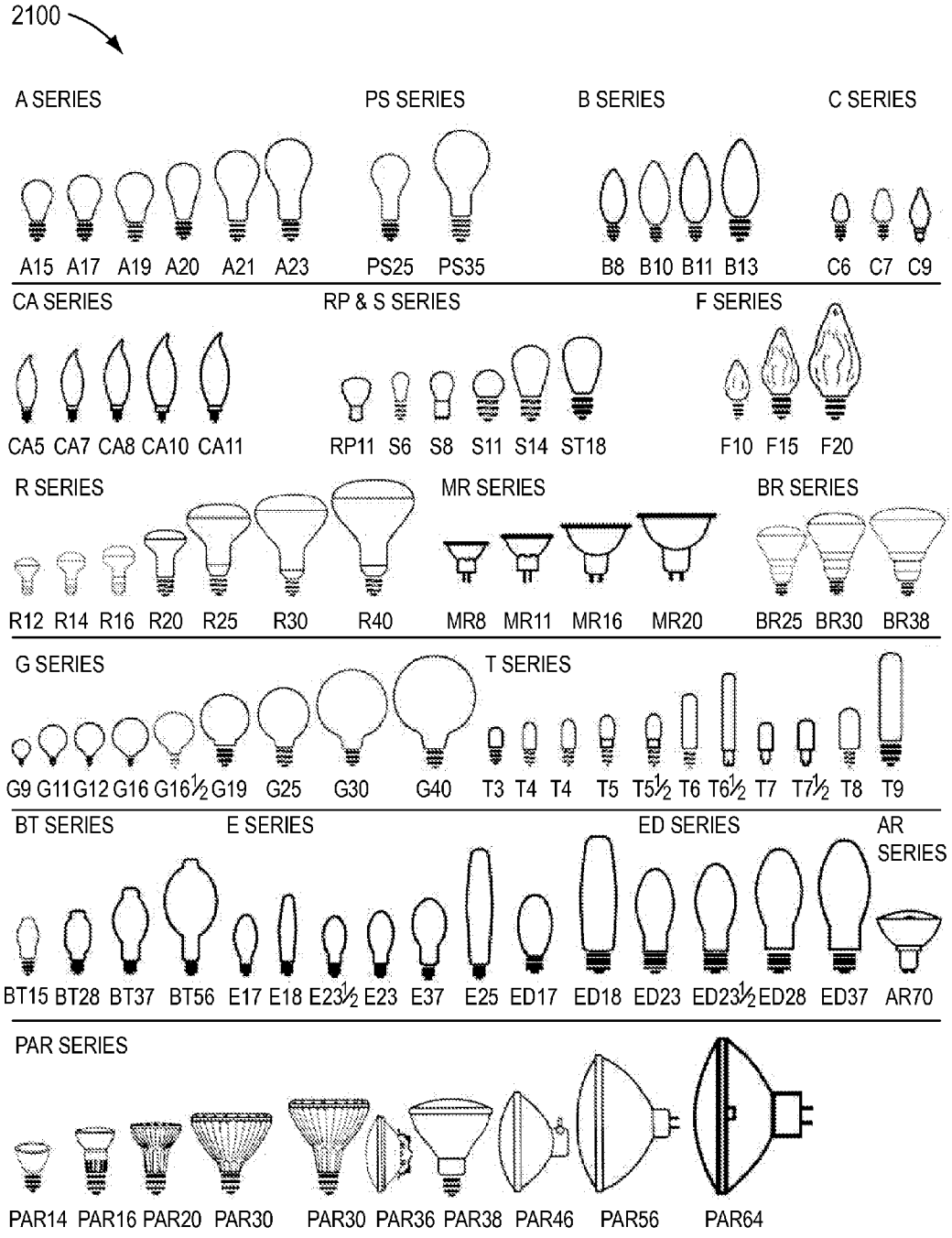
FIG. 21 shows lamps organized into several lamp types as used to implement some embodiments.

FIG. 21 shows lamps organized into several lamp types (e.g., lamp series, as shown). Some of the various lamps (e.g., "A Series", "PS Series", "B Series", "C Series", etc.) have different lamp bases. Such lamp bases can conform to any standard, some of which are included in the following tables (see Table 2 and Table 3).

TABLE 2

| Designation | Base Diameter (Crest of thread) | Name | IEC 60061-1 standard sheet |
|---|---|---|---|
| | 5 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-6-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |

TABLE 2-continued

| Designation | Base Diameter (Crest of thread) | Name | IEC 60061-1 standard sheet |
|---|---|---|---|
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, the base member of a lamp can be of any form factor configured to support electrical connections, which electrical connections can conform to any of a set of types or standards. For example, Table 3 gives standards (see "Type") and corresponding characteristics, including mechanical spacing between a first pin (e.g., a power pin) and a second pin (e.g., a ground pin).

TABLE 3

| Type | Standard | Pin center to center | Pin diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/230 V (EU) |
| G9.5 | | 9.5 mm | 3.10-3.25 mm | Common for theatre use, several variants |
| GU10 | | 10 mm | | Twist-lock 120/230-volt MR16 halogen lighting of 35/50 watt, since mid-2000 s |
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000 s |

TABLE 3-continued

| Type | Standard | Pin center to center | Pin diameter | Usage |
|---|---|---|---|---|
| G38 | | 38 mm | | Mostly used for high-wattage theatre lamps |
| GX53 | | 53 mm | | Twist-lock for puck-shaped under-cabinet compact fluorescents, since 2000s |

The listings above are merely representative and should not be taken to include all the standards or form factors that may be utilized within embodiments described herein.

Finally, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. An LED illumination apparatus comprising:

a lamp base comprising an inner volume; and an LED driver circuit disposed within the inner volume, wherein, the LED driver circuit comprises:

a first stage converter operably connected to an alternating current power source, the first stage converter configured to produce a half-wave rectified voltage waveform comprising a combined DC and twice line frequency ripple between a first terminal and a second terminal;

a second stage converter comprising:

inputs operably connected to the first terminal and to the second terminal; and two driving terminals; and a capacitor connected across the first terminal and the second terminal, the capacitor configured to store charge from the half-wave rectified voltage waveform and to discharge charge to the second stage, wherein, the capacitor is selected from a ceramic capacitor, a tantalum capacitor, and a thin film capacitor; and the capacitor is characterized by a capacitance from about 0.1 μF to about 50 μF; and the inner volume is characterized by a temperature from about 105° C. to about 175° C. when the LED illumination apparatus is operating; and at least one light emitting diode operably connected to the two driving terminals.

2. The apparatus of claim 1, wherein the ripple across the capacitor is at least 15 Volts.

3. The apparatus of claim 1, wherein the capacitor comprises multiple capacitors in parallel.

4. The apparatus of claim 1, wherein the LED driver circuit and the at least one LED are mounted on a printed circuit board.

5. The method of claim 1, wherein the capacitor comprises multiple capacitors in parallel.

6. The method of claim 1, wherein the LED driver circuit and the at least one LED are mounted on a printed circuit board.

7. The lamp of claim 1, wherein the capacitor comprises multiple capacitors in parallel.

8. The lamp of claim 1, wherein the LED driver circuit and the at least one LED are mounted on a printed circuit board.

9. A method for assembling an LED illumination apparatus comprising:

providing a lamp base, wherein the lamp base comprises an inner volume;

providing an LED driver circuit within the inner volume, wherein, the LED driver circuit comprises:

a first stage converter operably connected to an alternating current power source, the first stage converter configured to produce a half-wave rectified voltage waveform comprising a combined DC and twice line frequency ripple between a first terminal and a second terminal;

a second stage converter comprising;

inputs operably connected to the first terminal and to the second terminal; and two driving terminals; and a capacitor connected across the first terminal and the second terminal, the capacitor configured to store charge from the half-wave rectified voltage waveform and to discharge charge to the second stage, wherein, the capacitor is selected from a ceramic capacitor, a tantalum capacitor, and a thin film capacitor; and the capacitor is characterized by a capacitance from about 0.1 μF to about 50 μF; and the inner volume is characterized by a temperature from about 105° C. to about 175° C. when the LED illumination apparatus is operating; and providing at least one light emitting diode operably connected to the two driving terminals.

10. The method of claim 9, wherein the ripple across the capacitor is at least 15 Volts.

11. An LED lamp comprising:

a lamp base comprising an inner volume;

an LED driver circuit disposed within the inner volume, wherein, the LED driver circuit comprises:

a first stage converter operably connected to an alternating current power source, the first stage converter configured to produce a half-wave rectified voltage waveform comprising a combined DC and twice line frequency ripple between a first terminal and a second terminal;

a second stage converter comprising:

inputs operably connected to the first terminal and to the second terminal; and two driving terminals; and a capacitor connected across the first terminal and the second terminal, the capacitor configured to store charge from the half-wave rectified voltage waveform and to discharge charge to the second stage, wherein, the capacitor is selected from a ceramic capacitor, a tantalum capacitor, and a thin film capacitor; and the capacitor is characterized by a capacitance from about 0.1 μF to about 50 μF; and the inner volume is characterized by a temperature from about 105° C. to about 175° C. when the LED illumination apparatus is operating; and at least one light emitting diode operably connected to the two driving terminals.

12. The lamp of claim 11, wherein the lamp is characterized by a form factor selected from at least one of, an A series lamp, a PS series lamp, a B series lamp, and a C series lamp.

13. The lamp of claim 11, wherein the lamp is characterized by a form factor selected from at least one of, an MR series lamp, a BR series lamp, a G series lamp, a T series lamp, A BT series lamp, an E series lamp, an ED series lamp, an AR series lamp, and a PAR series lamp.

14. The lamp of claim 11, wherein the ripple across the capacitor is at least 15 Volts.

* * * * *